US009415960B2

(12) United States Patent
Asano et al.

(10) Patent No.: US 9,415,960 B2
(45) Date of Patent: Aug. 16, 2016

(54) PRINTING APPARATUS AND PRINTING METHOD

(71) Applicant: CANON KABUSHIKI KAISHA, Tokyo (JP)

(72) Inventors: Shinya Asano, Tokyo (JP); Atsushi Saito, Yokohama (JP); Tetsuya Ishikawa, Yokohama (JP); Takatoshi Nakano, Yokohama (JP); Yutaka Kano, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/671,429

(22) Filed: Mar. 27, 2015

(65) Prior Publication Data

US 2015/0284202 A1 Oct. 8, 2015

(30) Foreign Application Priority Data

Apr. 4, 2014 (JP) ..... 2014-077466

(51) Int. Cl.

| | |
|---|---|
| ***B65H 5/36*** | (2006.01) |
| ***B65H 5/06*** | (2006.01) |
| ***B65H 9/00*** | (2006.01) |
| ***B65H 29/58*** | (2006.01) |
| ***B41J 3/60*** | (2006.01) |

(Continued)

(52) U.S. Cl.

CPC ... *B65H 5/36* (2013.01); *B41J 3/60* (2013.01); *B41J 11/006* (2013.01); *B65H 5/062* (2013.01); *B65H 5/068* (2013.01); *B65H 9/00* (2013.01); *B65H 29/125* (2013.01); *B65H 29/58* (2013.01); *B65H 2220/02* (2013.01); *B65H 2301/3122* (2013.01); *B65H 2404/612* (2013.01); *B65H 2404/6111* (2013.01); *B65H 2404/63* (2013.01); *B65H 2511/11* (2013.01); *B65H 2511/20* (2013.01); *B65H 2511/214* (2013.01); *B65H 2511/514* (2013.01); *B65H 2601/12* (2013.01); *B65H 2701/1311* (2013.01); *B65H 2701/1313* (2013.01); *B65H 2801/15* (2013.01)

(58) Field of Classification Search

CPC ..... B65H 5/36; B65H 5/062; B65H 29/125; B65H 2404/612; B65H 2404/6112; B65H 2404/691; B65H 2404/74; B65H 2404/741; B65H 2404/7431; B41J 3/543; B41J 3/60; B41J 11/0045

USPC ..... 271/264

See application file for complete search history.

(56) References Cited

U.S. PATENT DOCUMENTS 4,692,773 A 9/1987 Saito et al.
4,695,855 A 9/1987 Ichihashi et al.

(Continued)

FOREIGN PATENT DOCUMENTS

JP 08-337011 12/1996

*Primary Examiner* — David H Bollinger

(74) *Attorney, Agent, or Firm* — Fitzpatrick, Cella, Harper & Scinto

(57) ABSTRACT

A sheet is conveyed with no slack between a first conveying path and a second conveying path, thus allowing a high-quality image to be printed on the sheet and suppressing a possible sheet jam. A conveying path with a changeable conveying path length is provided between a first conveying path including a pair of downstream side conveying rollers and a pair of downstream side conveying rollers and a second conveying path including a pair of downstream side conveying rollers and a pair of downstream side conveying rollers.

17 Claims, 18 Drawing Sheets

(51) Int. Cl.
*B65H 29/12* (2006.01)
*B41J 11/00* (2006.01)

(56) References Cited

U.S. PATENT DOCUMENTS

| | | | |
|---|---|---|---|
| 4,698,650 | A | 10/1987 | Watanabe et al. |
| 4,704,620 | A | 11/1987 | Ichihashi et al. |
| 5,019,840 | A | 5/1991 | Watanabe et al. |
| 5,131,539 | A | 7/1992 | Karita et al. |
| 5,162,818 | A | 11/1992 | Karita et al. |
| 5,244,092 | A | 9/1993 | Karita et al. |
| 5,477,244 | A | 12/1995 | Shibata et al. |
| 5,638,097 | A | 6/1997 | Takayanagi et al. |
| 5,721,581 | A | 2/1998 | Saito et al. |
| 5,859,653 | A | 1/1999 | Aoki et al. |
| 5,892,523 | A | 4/1999 | Tanaka et al. |
| 5,971,525 | A | 10/1999 | Inoue et al. |
| 5,988,787 | A | 11/1999 | Watanabe et al. |
| 6,092,891 | A | 7/2000 | Okubo et al. |
| 6,130,682 | A | 10/2000 | Kohno et al. |
| 6,213,464 | B1 | 4/2001 | Inoue et al. |
| 6,224,183 | B1 | 5/2001 | Kono et al. |
| 6,322,190 | B1 | 11/2001 | Kono et al. |
| 6,471,428 | B2 | 10/2002 | Iwasaki et al. |
| 6,567,187 | B1 | 5/2003 | Iwasaki et al. |
| 6,896,345 | B2 | 5/2005 | Nakayama et al. |
| 6,913,337 | B2 | 7/2005 | Kuronuma et al. |
| 7,048,356 | B2 | 5/2006 | Ishikawa et al. |
| 7,104,625 | B2 | 9/2006 | Kono et al. |
| 7,226,157 | B2 | 6/2007 | Nakazawa et al. |
| 7,661,786 | B2 | 2/2010 | Nakazawa et al. |
| 7,735,991 | B2 | 6/2010 | Asano |
| 7,866,789 | B2 | 1/2011 | Shigeno et al. |
| 8,240,802 | B2 | 8/2012 | Nakano et al. |
| 8,287,074 | B2 | 10/2012 | Kano et al. |
| 8,328,311 | B2 | 12/2012 | Nakano et al. |
| 8,348,401 | B2 | 1/2013 | Sekino et al. |
| 8,366,230 | B2 | 2/2013 | Taira et al. |
| 8,371,673 | B2 | 2/2013 | Maru et al. |
| 8,430,472 | B2 | 4/2013 | Nishikori et al. |
| 8,444,246 | B2 | 5/2013 | Muro et al. |
| 8,602,538 | B2 | 12/2013 | Sekino et al. |
| 8,608,271 | B2 | 12/2013 | Murayama et al. |
| 8,622,538 | B2 | 1/2014 | Miyakoshi et al. |
| 8,651,616 | B2 | 2/2014 | Maru et al. |
| 8,651,638 | B2 | 2/2014 | Ishikawa |
| 8,675,250 | B2 | 3/2014 | Muro et al. |
| 8,757,754 | B2 | 6/2014 | Azuma et al. |
| 8,876,280 | B2 | 11/2014 | Ishikawa et al. |
| 9,004,640 | B2 | 4/2015 | Ishikawa et al. |
| 9,028,029 | B2 | 5/2015 | Azuma et al. |
| 2002/0051669 | A1* | 5/2002 | Otsuka ..... B41J 3/60 400/619 |
| 2004/0140605 | A1* | 7/2004 | Tseng ..... B65H 5/38 271/3.05 |
| 2011/0032296 | A1 | 2/2011 | Nakano et al. |
| 2011/0090271 | A1 | 4/2011 | Shigeno et al. |
| 2011/0249062 | A1 | 10/2011 | Nakano et al. |
| 2011/0298849 | A1 | 12/2011 | Murayama et al. |
| 2011/0310152 | A1 | 12/2011 | Muro et al. |
| 2012/0026229 | A1 | 2/2012 | Kato et al. |
| 2012/0050375 | A1 | 3/2012 | Kano et al. |
| 2014/0232771 | A1 | 8/2014 | Kawatoko et al. |

* cited by examiner

PRINTING APPARATUS AND PRINTING METHOD

BACKGROUND OF THE INVENTION

1. Field of the Invention

The present invention relates to a printing apparatus and a printing method in which an image is printed on a sheet using a plurality of print sections positioned so as to be deviated from each other in a sheet conveying direction.

2. Description of the Related Art

In general, a conveying path along which a sheet is conveyed through a position opposite to a print section includes an upstream side conveying roller positioned on an upstream side of the print section in a sheet conveying direction and a downstream side conveying roller positioned on a downstream side of the print section in the sheet conveying direction. A speed at which the sheet is conveyed by the downstream side conveying roller is set higher than a speed at which the sheet is conveyed by the upstream side conveying roller. Furthermore, a sheet sandwiching force exerted by the downstream side conveying roller and a pinch roller opposite to the downstream side conveying roller is set weaker than a sheet sandwiching force exerted by the upstream side conveying roller and a pinch roller opposite to the upstream side conveying roller. Thus, the downstream side conveying roller conveys the sheet while causing slippage between the downstream side conveying roller and the sheet. As a result, the sheet can be adequately conveyed with no slack.

Japanese Patent Laid-Open No. H08-337011(1996) describes a printing apparatus including a first print section configured to print an image on one surface of a sheet and a second print section configured to print an image on the other surface of the sheet, the first and second print sections being positioned so as to be deviated from each other in the sheet conveying direction. A first conveying path along which the sheet is conveyed to the first print section includes an upstream side conveying roller and a downstream side conveying roller. Similarly, a second conveying path along which the sheet is conveyed to the second print section includes an upstream side conveying roller and a downstream side conveying roller. In the first print section, the sheet is conveyed with no slack by the upstream side conveying roller and downstream side conveying roller in the first conveying path. Similarly, in the second print section, the sheet is conveyed with no slack by the upstream side conveying roller and downstream side conveying roller in the second conveying path.

However, when the sheet is conveyed from the first conveying path to the second conveying path, the sheet is conveyed by the downstream side conveying roller in the first conveying path and the upstream side conveying roller in the second conveying path. In this case, the former downstream side conveying roller otherwise positioned on the downstream side in the conveying direction is positioned on the upstream side in the conveying direction. The latter upstream side conveying roller otherwise positioned on the upstream side in the conveying direction is positioned on the downstream side in the conveying direction. Thus, the slippage otherwise caused between the former downstream side conveying roller and the sheet does not occur, and the sheet may be slack between the former downstream side conveying roller and the latter upstream side conveying roller. Such slack of the sheet particularly causes disturbance when a high-quality image is printed and also causes a sheet jam.

SUMMARY OF THE INVENTION

The present invention provides a printing apparatus and a printing method which enable a high-quality image to be printed by conveying a sheet with no slack between a first conveying path and a second conveying path and which also allow suppression of a possible sheet jam.

In the first aspect of the present invention, there is provided a printing apparatus comprising: a first conveying unit configured to convey a sheet through a first conveying path; a first print unit configured to print an image on the sheet in the first conveying path; a second conveying unit configured to convey the sheet through the second conveying path; a second print unit configured to print an image on the sheet in the second conveying path; and a guide unit configured to guide the sheet conveyed through the first conveying path to the second conveying path through a third conveying path with a changeable length.

In the second aspect of the present invention, there is provided a printing method comprising: a first conveying step of conveying a sheet through a first conveying path; a first print step of printing an image on the sheet in the first conveying path; a second conveying step of conveying the sheet through the second conveying path; a second print step of printing an image on the sheet in the second conveying path; a step of guiding the sheet conveyed through the first conveying path to the second conveying path through a third conveying path; and a step of changing a length of the third conveying path so as to absorb slack in the sheet between the first conveying path and the second conveying path.

According to the present invention, the sheet conveyed along the first conveying path is guided to the second conveying path through the third conveying path with the changeable length. Thus, the sheet can be conveyed with no slack between the first conveying path and the second conveying path. As a result, a high-quality image can be printed, and a possible sheet jam can be suppressed. Furthermore, a decrease in print speed can be suppressed by setting the length of the third conveying path to an optimum value.

Further features of the present invention will become apparent from the following description of exemplary embodiments (with reference to the attached drawings).

DESCRIPTION OF THE EMBODIMENTS

Embodiments of the present invention will be described below based on the drawings. The embodiments described below are applied examples of an ink jet printing apparatus of what is called a full line type configured to enable an image to be printed on a print medium (sheet) using an ink jet print head. The printing apparatus according to the present invention is applicable to liquid ejecting apparatuses configured to execute various processes (printing, processing, coating, irradiation, reading, inspection, and the like) on various media (sheets) using a liquid ejecting head that enables a liquid to be ejected. The media (including print media) include various media such as paper, plastic, film, textiles, metal, and flexible substrates to which a liquid containing ink is applied and the material of which is not limited. A method for applying the liquid containing ink is not limited to a method for ejecting the liquid.

First Embodiment

Figure 1:
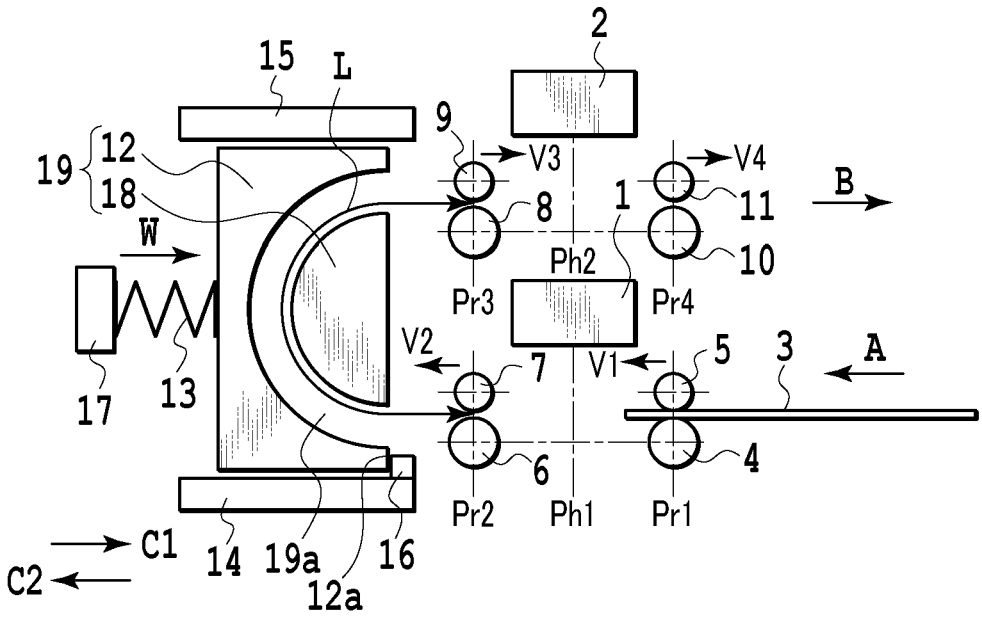
FIG. 1 is a configuration diagram of an important part of a printing apparatus according to a first embodiment of the present invention.

FIG. 1 is a schematic configuration diagram of an ink jet printing apparatus according to the present embodiment. The ink jet printing apparatus prints an image on a front surface and a back surface of a print medium such as a sheet using ink jet print heads 1 and 2.

The print heads 1 and 2 enable ink to be ejected through ejection ports at tips of nozzles. The plurality of nozzles are arranged to form a nozzle array extending all over the assumed maximum print width of a print medium 3. The print heads 1 and 2 are long-line-shaped ink jet print heads which may each be configured, for example, such that a plurality of unit nozzle chips with a plurality of nozzles arranged in a staggered manner is combined together or such that a plurality of nozzles is arranged in a line. The print heads 1 and 2 eject ink through ejection ports at the tips of the nozzles using ejection energy generating elements. The ejection energy generating elements may be, for example, electrothermal conversion elements (heaters), piezo elements, electrostatic elements, or MEMS elements. Each of the print heads 1 and 2 includes a total of three nozzle arrays, that is, a nozzle array for ejection of a cyan ink, a nozzle array for ejection of a magenta ink, and a nozzle array for ejection of a yellow ink. The number of ink colors and the number of nozzle arrays formed are each not limited to three but are optional. The print heads 1 and 2 are supplied with ink from corresponding ink tanks (not depicted in the drawings) through ink tubes. The print heads 1 and 2 may each be a unit integrated with ink tanks that store corresponding inks. The print heads 1 and 2 are held in a head holder (not depicted in the drawings).

In a first print section, the print medium 3 is conveyed in a direction of arrow A through a first conveying path, and in a second print section, conveyed in a direction of arrow B through a second conveying path. The print head 1 prints an image on the print medium 3 in the first conveying path. The print head 2 prints an image on the print medium 3 in the second conveying path.

In the first conveying path, a pair of conveying rollers (first pair of upstream side conveying rollers) is provided on a conveying-direction (direction of arrow A) upstream side of the print head 1, the pair including a main conveying roller 4 and a main pinch roller 5 that rotates in conjunction with the main conveying roller 4. Furthermore, a pair of conveying rollers (first pair of downstream side conveying rollers) is provided on a conveying-direction downstream side of the print head 1, the pair including a sub conveying roller 6 and a sub pinch roller 7 that rotates in conjunction with the sub conveying roller 6. Similarly, in the second conveying path, a pair of conveying rollers (second pair of upstream side conveying rollers) is provided on the conveying-direction (direction of arrow B) upstream side of the print head 2, the pair including a main conveying roller 8 and a main pinch roller 9 that rotates in conjunction with the main conveying roller 8. Furthermore, a pair of conveying rollers (second pair of downstream side conveying rollers) is provided on the conveying-direction downstream side of the print head 2, the pair including a sub conveying roller 10 and a sub pinch roller 11 that rotates in conjunction with the sub conveying roller 10. The main pinch rollers 5 and 9 that rotate in conjunction with the main conveying rollers and the sub pinch rollers 7 and 11 that rotate in conjunction with the sub conveying rollers are biased toward the corresponding main conveying rollers 4 and 8 and sub conveying rollers 6 and 10.

A position where an image is printed by the print head 1 is denoted by Ph1. The position of a nip portion between the main conveying roller 4 and the main pinch roller 5 is denoted by Pr1. The position of a nip portion between the sub conveying roller 6 and the sub pinch roller 7 is denoted by Pr2. Moreover, a position where an image is printed by the print head 2 is denoted by Ph2. The position of a nip portion between the main conveying roller 8 and the main pinch roller 9 is denoted by Pr3. The position of a nip portion between the sub conveying roller 10 and the sub pinch roller 11 is denoted by Pr4.

The speed at which the print medium 3 is conveyed by the pair of conveying rollers 6 and 7 provided on the conveying-direction downstream side of the print head 1 is set higher than the speed at which the print medium 3 is conveyed by the pair of conveying rollers 4 and 5 provided on the conveying-direction upstream side of the print head 1. Furthermore, a sandwiching force exerted on the print medium 3 by the pair of conveying-direction downstream side conveying rollers 6 and 7 is set weaker than a sandwiching force exerted on the print medium 3 by the pair of conveying-direction upstream side conveying rollers 4 and 5. Thus, when the print medium 3 is conveyed by the pair of conveying rollers 4 and 5 and the pair of conveying rollers 6 and 7 while being sandwiched between the conveying rollers, slippage occurs between the print medium 3 and the pair of conveying-direction downstream side conveying rollers 6 and 7. Similarly, the speed at which the print medium 3 is conveyed by the pair of conveying rollers 10 and 11 provided on the conveying-direction downstream side of the print head 2 is set higher than the speed at which the print medium 3 is conveyed by the pair of conveying rollers 8 and 9 provided on the conveying-direction upstream side of the print head 2. Furthermore, a sandwiching force exerted on the print medium 3 by the pair of conveying-direction downstream side conveying rollers 10 and 11 is set weaker than a sandwiching force exerted on the print medium 3 by the pair of conveying-direction upstream side conveying rollers 8 and 9. Thus, when the print medium 3 is conveyed by the pair of conveying rollers 8 and 9 and the pair of conveying rollers 10 and 11 while being sandwiched between the conveying rollers, slippage occurs between the print medium 3 and the pair of conveying-direction downstream side conveying rollers 10 and 11.

The conveying speed of the pair of conveying rollers 4 and 5 is denoted by V1. The conveying speed of the pair of conveying rollers 6 and 7 is denoted by V2. The conveying speed of the pair of conveying rollers 8 and 9 is denoted by V3. The conveying speed of the pair of conveying rollers 10 and 11 is denoted by V4. Then, the conveying speeds are in relations represented by:

$$V2>V1 \quad \text{Expression (1)}$$

$$V4>V3 \quad \text{Expression (2)}$$

When the same conveying section is shared by the first print section and the second print section, the speeds V1 and V3 are in a relation represented by:

$$V1=V3 \quad \text{Expression (3)}$$

Furthermore, the sandwiching force of the pair of conveying rollers 4 and 5 is denoted by P1. The sandwiching force of the pair of conveying rollers 6 and 7 is denoted by P2. The sandwiching force of the pair of conveying rollers 8 and 9 is denoted by P3. The sandwiching force of the pair of conveying rollers 10 and 11 is denoted by P4. Then, the sandwiching forces are in relations represented by:

$$P1>P2 \quad \text{Expression (4)}$$

$$P3>P4 \quad \text{Expression (5)}$$

When the same conveying section is shared by the first print section and the second print section, the sandwiching forces P1 and P3 are in a relation represented by:

$$P1=P3 \quad \text{Expression (6)}$$

Between the first print section and the second print section, a third conveying path with a U-turn conveying path 19*a* corresponding to a curved portion is formed in order to convey the print medium 3 from the first print section to the second print section. The U-turn conveying path 19*a* is formed of a guide element. The guide element 19 includes a U-turn outer peripheral guide 12 forming an outer peripheral guide surface and a U-turn inner peripheral guide 18 forming an inner peripheral guide surface. The print medium 3 is conveyed from the first print section to the second print section along an inner periphery of the outer peripheral guide and an outer periphery of the inner peripheral guide 18.

The guide element 19 forming the U-turn conveying path 19*a* is guided by guides 14 and 15 so as to be movable in the directions of arrows C1 and C2. The position of the U-turn conveying path 19*a* is displaced in the direction of arrow C1 or C2 to change a conveying path distance L from the position Pr2 of the nip portion between the sub conveying roller 6 and the sub pinch roller 7 to the position Pr3 of the nip portion between the main conveying roller 8 and the main pinch roller 9. The guide element 19 is biased in the direction of arrow C1 by the force W of a U-turn portion spring 13 positioned between the guide element 19 and a fixed block 17 to keep the stopper portion 12*a* of the outer peripheral guide 12 in abutting contact with a U-turn portion stopper 16. This regulates a movement limit position of the guide element 19 in the direction of arrow C1.

Now, a conveying operation and a printing operation performed by thus configured printing apparatus will be described based on FIGS. 2A to 5.

Figure 2A:
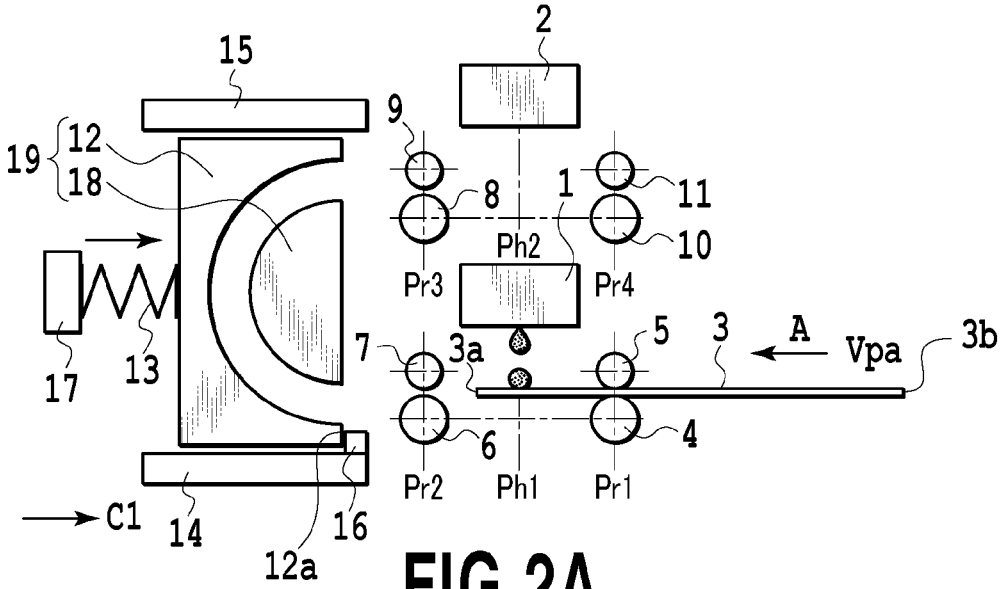
FIG. 2A, FIG. 2B, and FIG. 2C are each a diagram illustrating a sheet conveying operation in the printing apparatus in FIG. 1.

First, as depicted in FIG. 2A, the print medium 3 fed to the first print section is conveyed in the direction of arrow A while being held at the nip portion between the main conveying roller 4 and the main pinch roller 5. The conveying speed for the print medium 3 at the position Pr1 of the nip portion of the pair of conveying rollers 4 and 5 is denoted by Vpa. When a leading end 3*a* of the print medium 3 is conveyed to a print position Ph1 in the first print section, printing of an image using ink ejected by the print head 1 starts to be performed on a front surface (one surface) of the print medium 3.

Figure 2B:
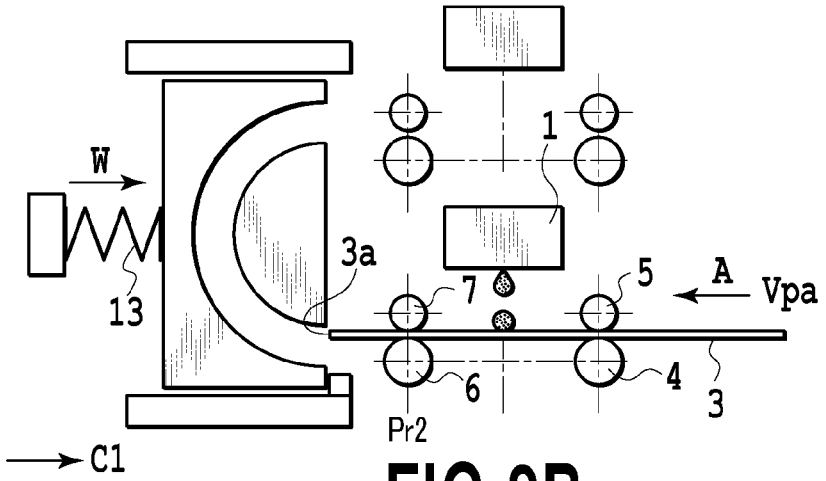

Subsequently, as depicted in FIG. 2B, the leading end 3*a* of the print medium 3 reaches the position Pr2 of the nip portion between the sub conveying roller 6 and the sub pinch roller 7. Then, the print medium 3 is conveyed by the pair of conveying rollers 4 and 5 and the pair of conveying rollers 6 and 7. The print medium 3 is then conveyed while slipping on the pair of conveying rollers 6 and 7 as described above. At this time, the conveying speed for the print medium 3 remains at Vpa.

Figure 2C:
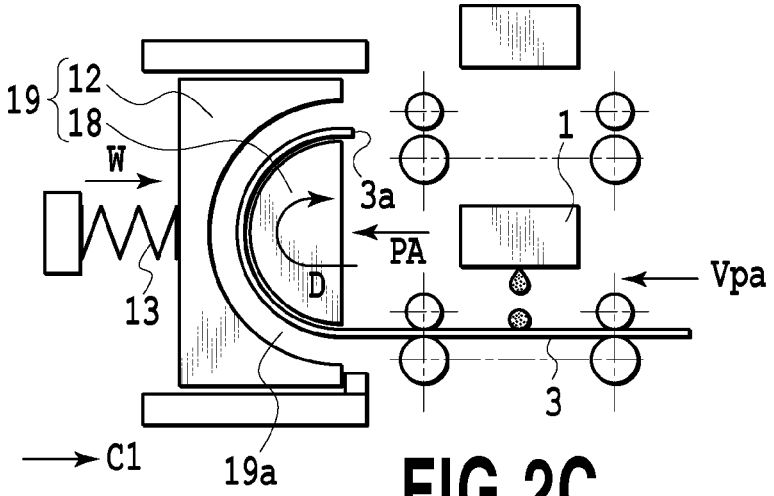

Subsequently, as depicted in FIG. 2C, the print medium 3 is conveyed in the direction of arrow D along the inner periphery of the outer peripheral guide 12 and the outer periphery of the inner peripheral guide 18, which form the U-turn conveying path 19*a*. At this time, the print medium 3 is bent to generate a force PA that causes the print medium 3 to push the guide element in the direction of arrow C2. The force W of the spring 13 which biases the guide element in the direction of arrow C1 is set stronger than the force PA as indicated by:

$$W>PA \quad (7)$$

Thus, the guide element 19 does not move, and at this time, the conveying speed for the print medium 3 remains at Vpa.

Figure 3A:
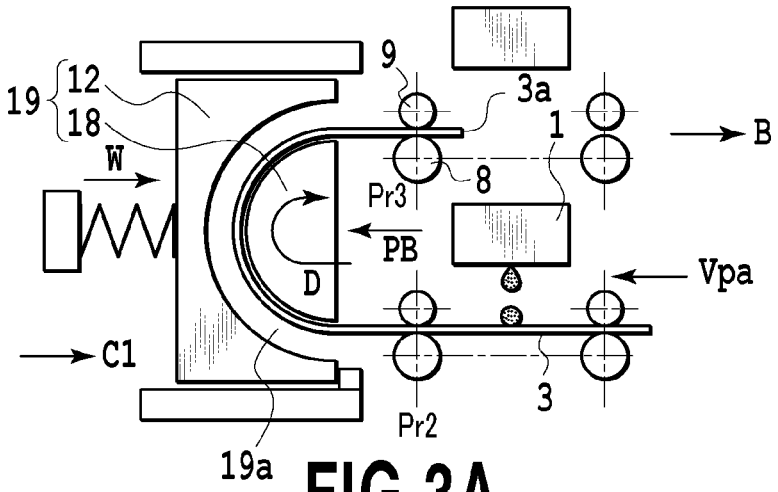
FIG. 3A, FIG. 3B, and FIG. 3C are each a diagram illustrating the sheet conveying operation in the printing apparatus in FIG. 1.

Subsequently, as depicted in FIG. 3A, the leading end 3*a* of the print medium 3 reaches the position Pr3 of the nip portion between the main conveying roller 8 and the main pinch roller 9. Then, the print medium 3 is conveyed in the direction of arrow B by the pair of conveying rollers 8 and 9. At this time, the print medium 3 is bent to generate a force PB that causes the print medium 3 to push the guide element in the direction of arrow C2. The force W of the spring 13 which biases the guide element in the direction of arrow C1 is set stronger than the force PB as indicated by:

$$W>PB \quad (8)$$

Thus, the guide element 19 does not move, and at this time, the conveying speed for the print medium 3 remains at VPa.

Figure 3B:
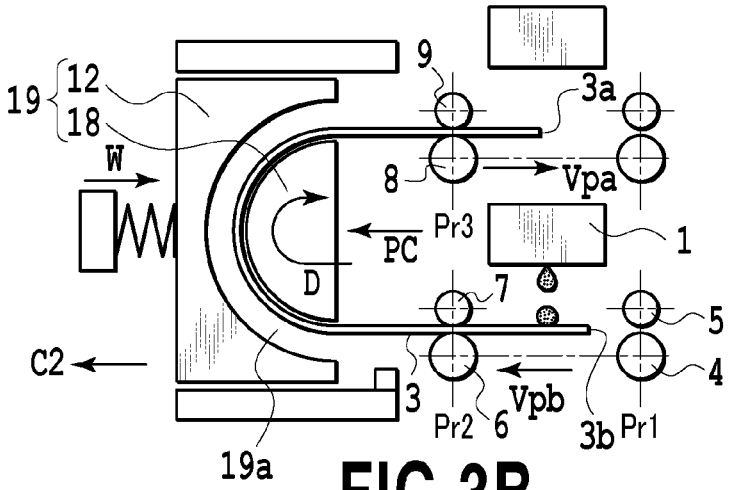

Subsequently, the print medium 3 is conveyed as depicted in FIG. 3B to allow a trailing end 3*b* of the print medium 3 to leave the position Pr1 of the nip portion of the pair of conveying rollers 4 and 5 in the first print section. Thus, a trailing end 3*b* side portion of the print medium 3 is conveyed by the pair of conveying rollers 6 and 7, whereas a leading end 3*a* side portion of the print medium 3 is conveyed by the pair of conveying rollers 8 and 9.

The conveying speed V2 of the pair of conveying rollers 6 and 7 and the conveying speed V3 of the pair of conveying rollers 8 and 9 are in a relation represented by:

$$V2>V3 \quad \text{Equation (9)}$$

A relation represented by Expression (10) is present between a conveying speed Vpb for the print medium 3 at the position Pr2 of the nip portion of the pair of conveying rollers 6 and 7 and a conveying speed Vpa for the print medium 3 at the position Pr3 of the nip portion of the pair of conveying rollers 8 and 9.

$$Vpa<Vpb \quad \text{Expression (10)}$$

The difference between the conveying speeds Vpa and Vpb acts to make a portion of the print medium 3 between the pair of conveying rollers 6 and 7 and the pair of conveying rollers 8 and 9 slack to generate a force PC that presses the guide element 19 hard in the direction of arrow C2. The force W of the spring 13 which biases the guide element in the direction of arrow C1 is set weaker than the force PC as indicated by:

$$W<PC \quad \text{Expression (11)}$$

Therefore, the guide element 19 moves in the direction of arrow C2. Thus, the position of the U-turn conveying path 19*a* is displaced in the direction of arrow C2 to increase the conveying path distance L (see FIG. 1) between the pair of conveying rollers 6 and 7 and the pair of conveying rollers 8 and 9. As a result, the slack is absorbed by a portion of the print medium 3 located at the U-turn conveying path 19*a*, allowing the print medium 3 to be conveyed with no slack.

Figure 3C:
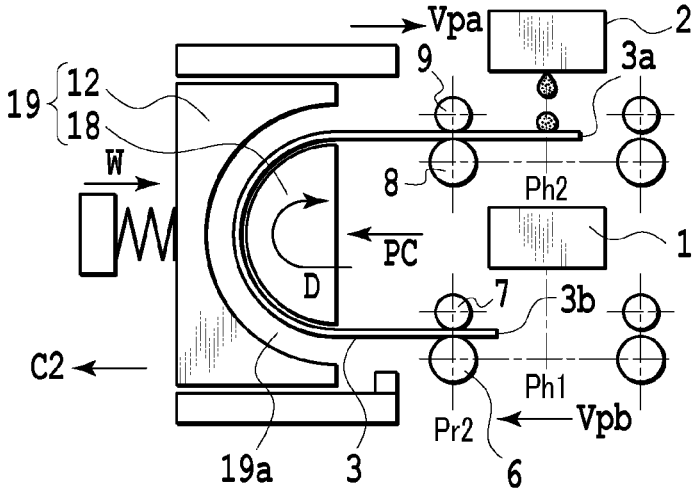

Subsequently, the print medium 3 is conveyed as depicted in FIG. 3C, and the trailing end 3*b* of the print medium 3 passes through the print position Ph1. Thus, the printing of the front surface of the print medium 3 using the print head 1 ends. When the leading end 3*a* of the print medium 3 reaches the print position Ph2 in the second print section, printing of the back surface (the other surface) of the print medium 3 using the print head 2 is started. As is the case with FIG. 3B, the difference between the conveying speeds Vpa and Vpb acts to make the portion of the print medium 3 between the pair of conveying rollers 6 and 7 and the pair of conveying rollers 8 and 9 slack to generate the force PC that presses the guide element hard in the direction of arrow C2. Thus, as is the case with FIG. 3B, the guide element 19 is moved in the direction of arrow C2.

The amount of slack in the portion of the print medium 3 between the pair of conveying rollers 6 and 7 and the pair of conveying rollers 8 and 9 depends on the difference in conveying speed between the pair of conveying-direction upstream side conveying rollers and the pair of conveying-direction downstream side conveying rollers in each of the first and second print sections. When, in each of the first and second print sections, the conveying speed of the pair of conveying-direction downstream side conveying rollers is increased by 3% with respect to the pair of conveying-direction upstream side conveying rollers, the speeds V1, V2, V3, and V4 are in a relation represented by:

$$V1:V2:V3:V4=1:1.03:1:1.03 \quad \text{Expression (12)}$$

For example, when the print medium 3 has an A4 size and is 297 mm in length in the conveying direction, slack of up to 8.91 mm in length is to be created. Given that the print medium 3 is conveyed with the slack uncontrolled, the print medium 3 may be jammed in the U-turn conveying path 19*a*. Furthermore, in accordance with Expressions (4), (5), and (6) illustrated above, the sandwiching force of the pair of conveying rollers 6 and 7 and the sandwiching force P3 of the pair of conveying rollers 8 and 9 are in a relation represented by:

$$P3>P2 \quad \text{Expression (13)}$$

Thus, the sandwiching force P3 of the pair of conveying rollers 8 and 9 is stronger than the sandwiching force P2 of the pair of conveying rollers 6 and 7. Consequently, when the print medium 3 has high rigidity, the print medium 3 may be conveyed in a direction opposite to the direction of arrow D. If the print medium 3 thus has high rigidity, the slack created in the print medium 3 may acts as a disturbance when a high-quality photograph image is printed, degrading the quality of a print image. Furthermore, if the print medium 3 has low rigidity, the slack may lead to a jam.

In the present embodiment, the position of the U-turn conveying path 19*a* is displaced in the direction of arrow C2 to allow the portion of the print medium 3 between the pair of conveying rollers 6 and 7 and the pair of conveying rollers 8 and 9 to absorb the slack. This allows the print medium 3 to be conveyed with no slack.

The maximum distance the guide element 19 moves in the direction of arrow C2, in other words, the maximum amount of displacement of the U-turn conveying path 19*a* in the direction of arrow C2, is half the amount of slack in the portion of the print medium 3 between the pair of conveying rollers 6 and 7 and the pair of conveying rollers 8 and 9. For example, if, when the conveying speed of the pair of conveying-direction downstream side conveying rollers is increased by 3% with respect to the pair of conveying-direction upstream side conveying roller, slack of up to 8.91 mm is created in the print medium 3 of A4 size, then the maximum amount of displacement of the U-turn conveying path 19*a* in the direction of arrow C2 is 4.455 mm. The maximum amount of displacement in the directions of arrow C2 is set to a value at which slack created in a print medium 3 that is longest in the conveying direction can be absorbed.

Figure 4A:
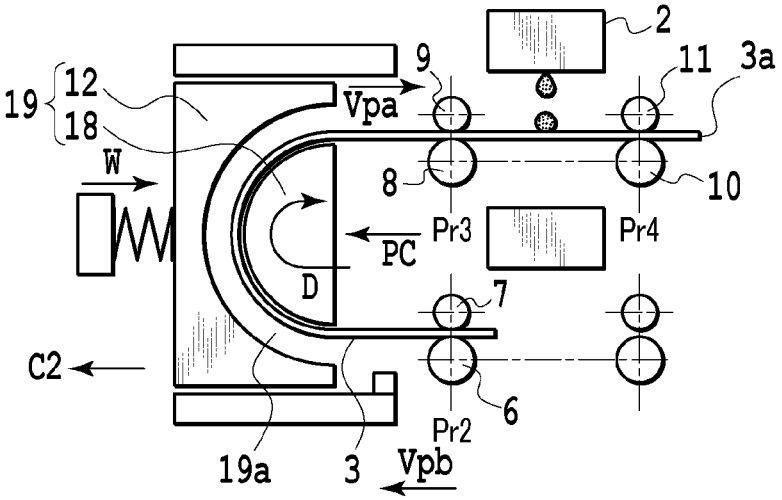
FIG. 4A, FIG. 4B, and FIG. 4C are each a diagram illustrating the sheet conveying operation in the printing apparatus in FIG. 1.

Subsequently, the print medium 3 is conveyed as depicted in FIG. 4A, and the leading end 3*a* of the print medium 3 reaches the position Pr4 of the nip portion of the pair of conveying rollers 10 and 11. As is the case with FIG. 3B, the force PC that pushes the guide element 19 hard in the direction of arrow C2 is exerted due to the difference between the conveying speed Vpb at the position Pr2 of the nip portion of the pair of conveying rollers 6 and 7 and the conveying speed Vpa at the position Pr3 of the nip portion of the pair of conveying rollers 8 and 9. Thus, as is the case with FIG. 3B, the guide element is moved in the direction of arrow C2.

Figure 4B:
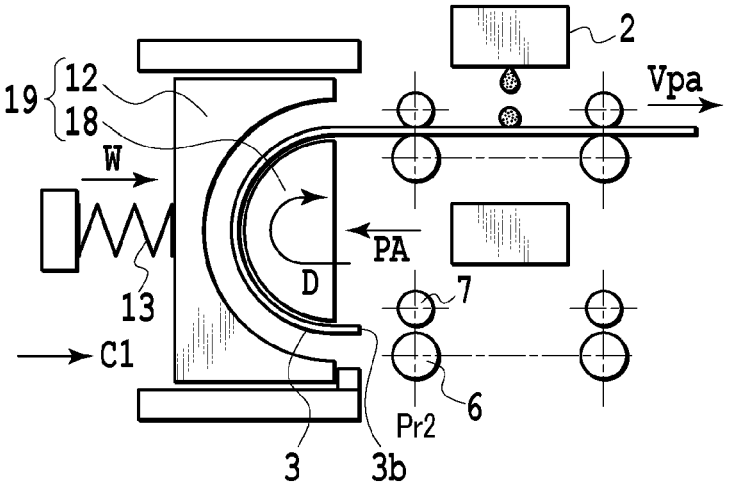

Subsequently, the print medium 3 is conveyed as depicted in FIG. 4B, and the trailing end 3*b* of the print medium 3 leaves the position Pr2 of the nip portion of the pair of conveying rollers 6 and 7. This allows the slack of the print medium 3 to be taken up. The force that pushes the guide element 19 in the direction of arrow C2 returns to the force PA exerted by bending of the print medium 3 as is the case with FIG. 2C. As indicated by Expression (7) described above, the force W of the spring 13 is set stronger than the force PA, and thus, the guide element 19 gradually moves in the direction of arrow C1 due to the bias force of the spring 13. At this time, the conveying speed for the print medium 3 is at Vpa.

Figure 4C:
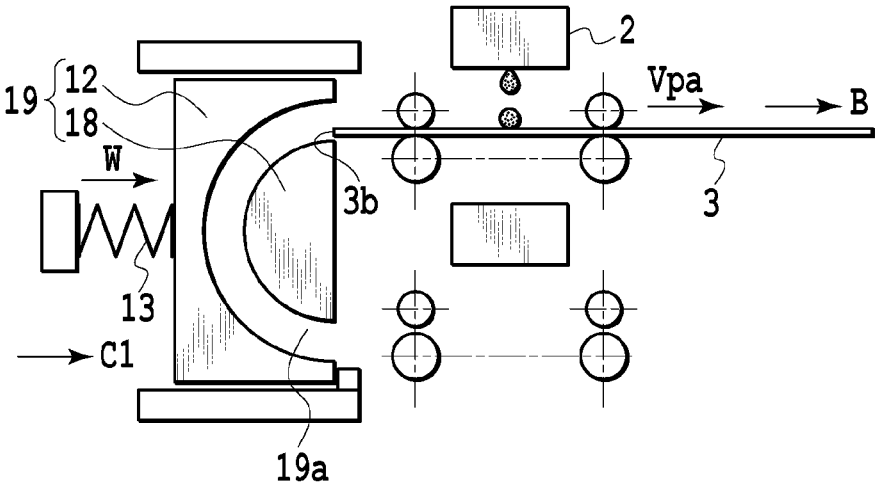

Subsequently, the print medium 3 is conveyed as depicted in FIG. 4C, and the trailing end 3*b* of the print medium 3 leaves the U-turn conveying path 19*a*. At this time, the conveying speed for the print medium 3 remains at Vpa.

Figure 5:
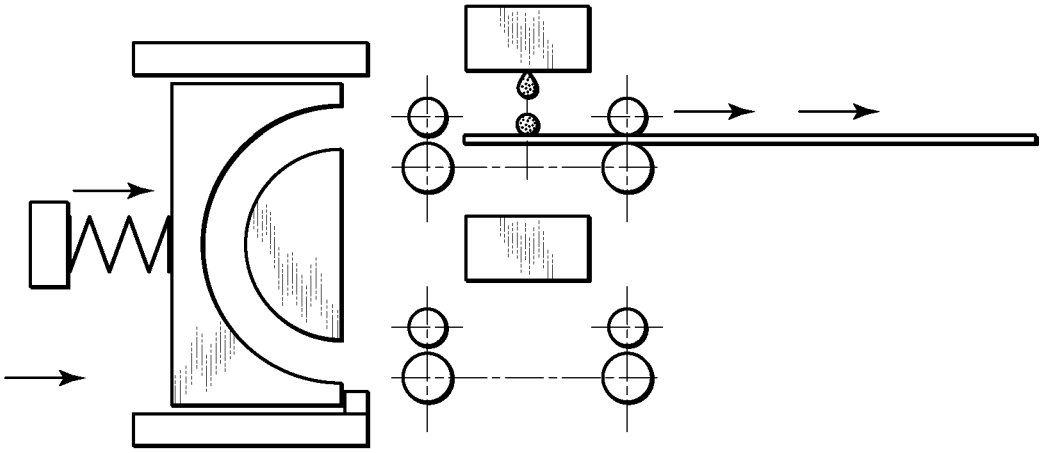
FIG. 5 is a diagram illustrating the sheet conveying operation in the printing apparatus in FIG. 1.

Subsequently, the print medium 3 is conveyed as depicted in FIG. 5, and the trailing end 3*b* of the print medium 3 leaves the position Pr3 of the nip portion of the pair of conveying rollers 8 and 9 and then passes through the print portion Ph2 of the print head 2. Thus, printing of the back surface of the print medium 3 using the print head 2 ends. At this time, the conveying speed for the print medium 3 is at Vpb. Subsequently, the print medium 3 leaves the position Pr4 of the nip portion of the pair of conveying rollers 10 and 11 and is discharged.

The force W of the U-turn portion spring 13 is determined by the relation between the forces PA and PB exerted by bending of the print medium 3 and the force PC resulting from the difference in the conveying speed for the print medium 3. Furthermore, forces PA and PB exerted by bending of the print medium 3 vary in accordance with the curvature of the U-turn conveying path 19*a*. Thus, the relation between the forces PA and PB and the curvature of the U-turn conveying path 19*a* is set based on measurement results for the forces PA and PB exerted when various print media 3 are used. Additionally, the force W of the U-turn portion spring 13 may be adjustable in accordance with the rigidity of the print medium 3 used.

As described above, the position of the U-turn conveying path is displaced to change the length of the third conveying path, allowing absorption of the slack of the print medium resulting from the difference between the conveying speed in the first print section and the conveying speed in the second print section. This eliminates the cause of a disturbance associated with the conveying operation for the print medium, allowing a high-quality image to be printed on the front surface and back surface of the print medium. Furthermore, the print medium can be reliably conveyed without being jammed.

Second Embodiment

Figure 6:
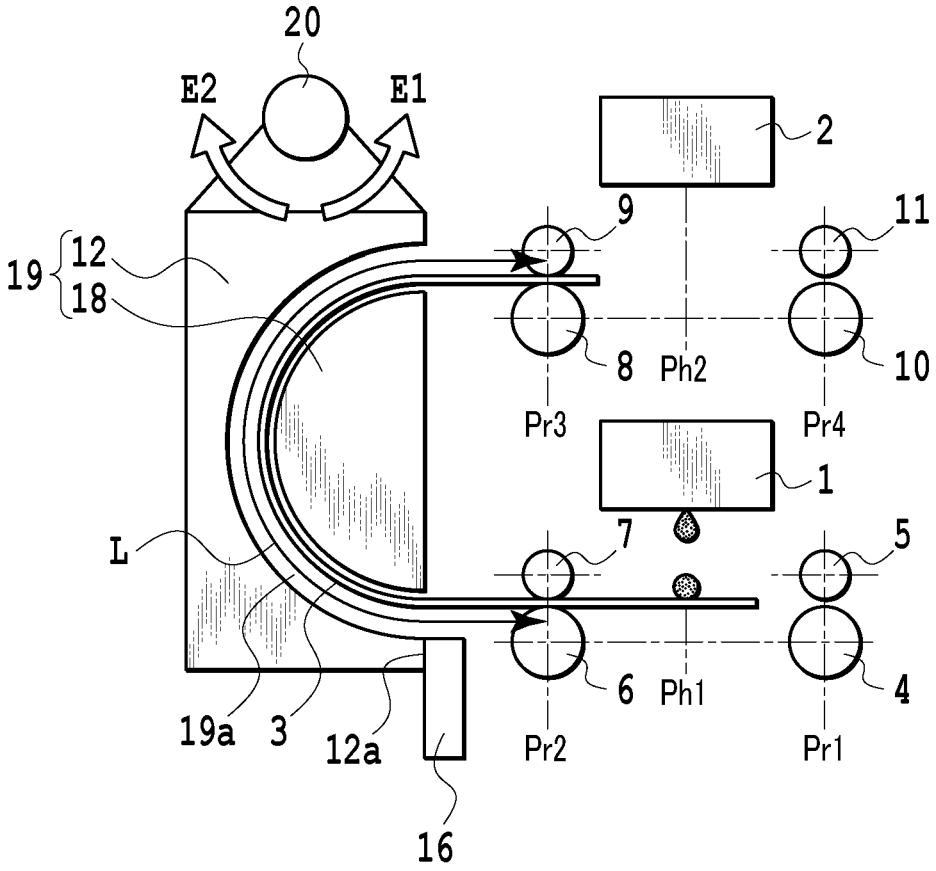
FIG. 6 is a configuration diagram of an important part of a printing apparatus according to a second embodiment of the present invention.

FIG. 6 is a diagram illustrating an important part of a printing apparatus according to a second embodiment of the present invention.

The guide element 19 forming a U-turn conveying path 19*a* along which the print medium 3 is conveyed from the first print section to the second print section is provided between the first print section and the second print section. The guide element 19 includes the U-turn outer peripheral guide 12 and the U-turn inner peripheral guide 18. The print medium 3 conveyed to first print section is conveyed along the inner periphery of the outer peripheral guide 12 and the outer periphery of the inner peripheral guide 18. The guide element 19 is provided so as to be able to pivot around a shaft 20 in the directions of arrows E1 and E2. It is possible to change, in accordance with the pivoting of the guide element 19, the conveying path distance L between the position Pr2 of the nip portion of the pair of conveying rollers 6 and 7 in the first print section and the position Pr3 of the nip portion of the pair of conveying rollers 8 and 9 in the second print section. The guide element 19 is biased in the direction of arrow E1 by the weight of the guide element 19. The stopper portion 12*a* of the outer peripheral guide 12 is in abutting contact with the stopper 16 to regulate a pivot limit position in the direction of arrow E1. The behavior of the print medium 3 and the movement of the guide element 19 are similar to those in the above-described first embodiment.

Third Embodiment

Figure 7:
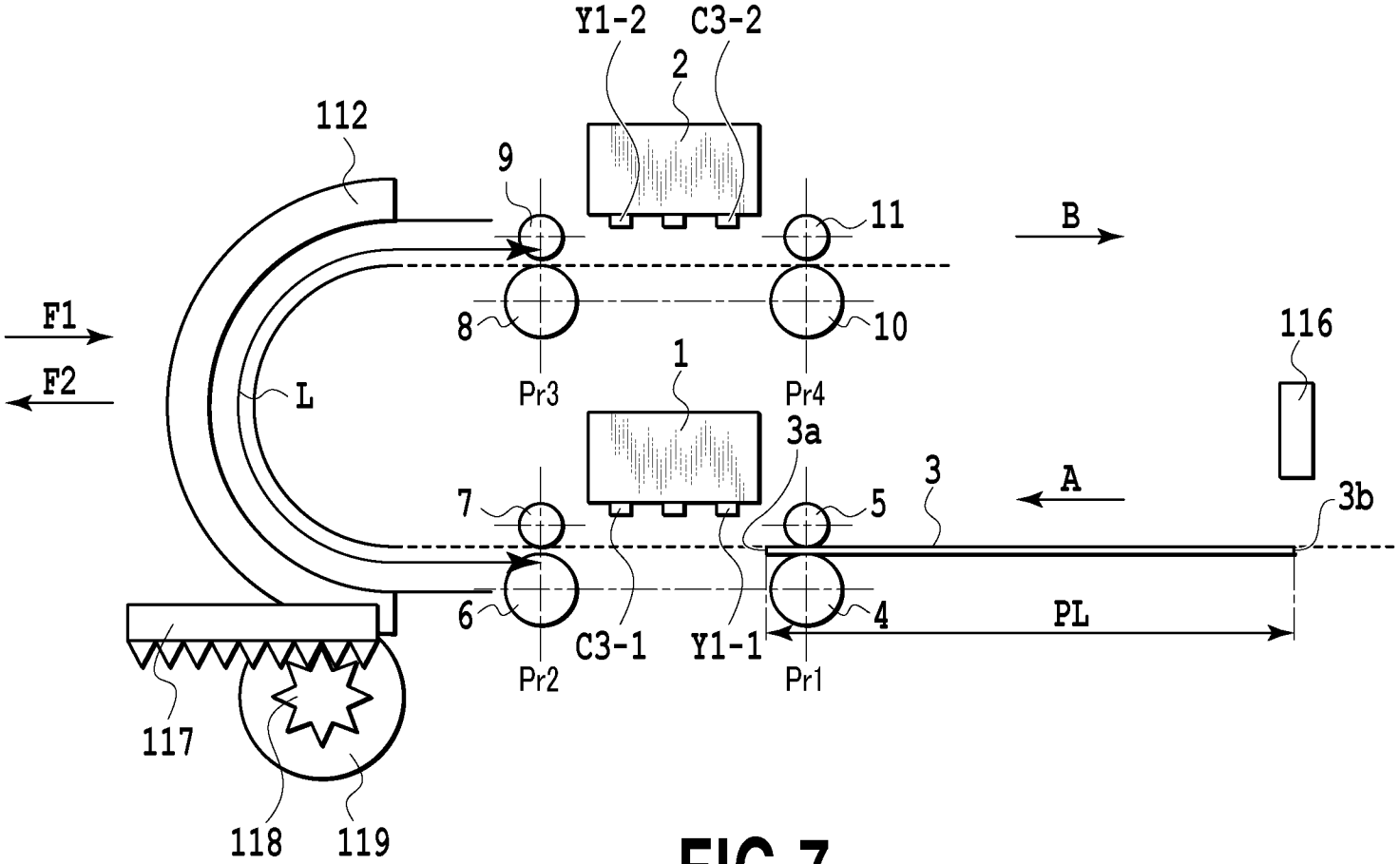
FIG. 7 is a configuration diagram of an important part of a printing apparatus according to a third embodiment of the present invention.

FIG. 7 is a schematic configuration diagram of an ink jet printing apparatus according to the present embodiment. An image is printed on the front surface and back surface of the print medium 3 such as a sheet using ink jet print heads 1 and 2.

Figure 9:
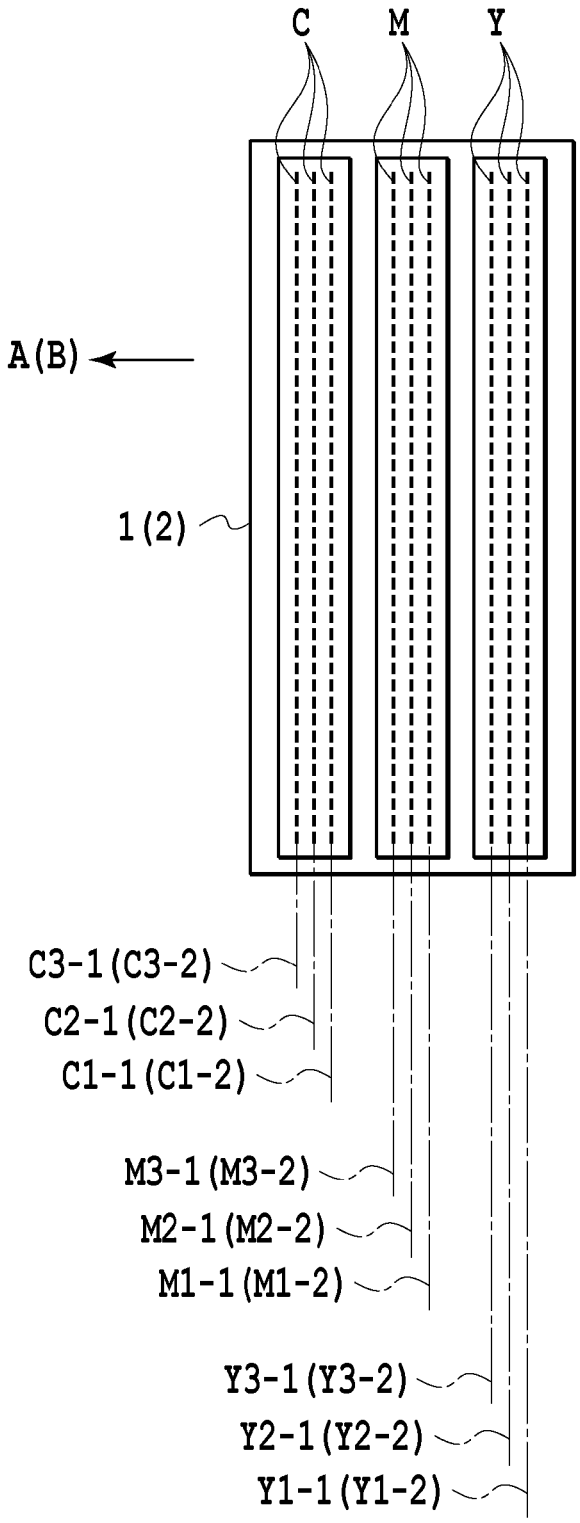
FIG. 9 is a diagram illustrating a print head in the printing apparatus in FIG. 7.

First, since the print heads 1 and 2 are similarly configured, the configurations will be described based on FIG. 9, using the print head 1 as a representative. FIG. 9 is a bottom view of the print head 1 as seen from an ink ejection port side. An ink jet printing apparatus uses ejection energy generating elements such as electrothermal conversion elements (heaters), piezo elements, electrostatic elements, or MEMS (Micro Electro Mechanical Systems) to eject ink through ejection ports at nozzle tips. The printing apparatus in the present example is a printing apparatus of what is called a full line type, and the print head 1 is a long-line-shaped ink jet print head extending over the maximum print width of the print medium 3. In the print head 1 in the present example, nozzle arrays are formed to extend all over the print medium 3 in a width direction thereof.

The print head 1 includes nozzles Y through which a yellow ink is ejected, nozzles M through which a magenta ink is ejected, and nozzles C through which a cyan ink is ejected. For each color ink, three arrays of nozzles are formed. Furthermore, nozzles Y, M, and C are positioned in this order along the conveying direction (arrow A) for the print medium 3. A plurality of the nozzles Y is arranged to form nozzle arrays Y1-1, Y2-1, and Y3-1 in the print head 1 and to form nozzle arrays Y1-2, Y2-2, and Y3-2 in the print head 2. A plurality of the nozzles M is arranged to form nozzle arrays M1-1, M2-1, and M3-1 in the print head 1 and to form nozzle arrays M1-2, M2-2, and M3-2 in the print head 2. A plurality of the nozzles C is arranged to form nozzle arrays C1-1, C2-1, and C3-1 in the print head 1 and to form nozzle arrays CM1-2, C2-2, and C3-2 in the print head 2. These nozzle arrays are formed to extend along a direction intersecting (in the present example, orthogonal to) the conveying direction for the print medium 3.

The number of ink colors and the number of print heads are each not limited to three but is optional. The print heads 1 and 2 are supplied with ink from corresponding ink tanks (not depicted in the drawings) via ink tubes. The print head 1 may provide a unit integrated with the corresponding ink tanks, and the print head 2 may provide a unit integrated with the corresponding ink tanks. The print heads 1 and 2 are held in corresponding head holders (not depicted in the drawings).

In the printing apparatus in FIG. 7, the conveying section (first conveying section) configured to convey the print medium 3 is provided in the first print section provided with the print head 1. As is the case with the above-described embodiments, the first conveying section in the present example includes, on the upstream side of the print head 1 in the conveying direction (direction of arrow A), the pair of conveying rollers with the main conveying roller 4 serving as a driving roller and the main pinch roller 5 serving as a driven roller. The first conveying section also includes, on the downstream side of the print head 1 in the conveying direction, the pair of conveying rollers with the sub conveying roller 6 serving as a driving roller and the sub pinch roller 7 serving as a driven roller. The conveying section (second conveying section) configured to convey the print medium 3 is provided in the second print section provided with the print head 2. As is the case with the above-described embodiments, the second conveying section in the present example includes, on the upstream side of the print head 2 in the conveying direction (direction of arrow B), the pair of conveying rollers with the main conveying roller 8 serving as a driving roller and the main pinch roller 9 serving as a driven roller. The second conveying section also includes, on the downstream side of the print head 2 in the conveying direction, the pair of conveying rollers with the sub conveying roller 10 serving as a driving roller and the sub pinch roller 11 serving as a driven roller.

The main pinch rollers 5 and 9 and sub pinch rollers 7 and 11, rotated in conjunction with the corresponding conveying rollers, are biased by pinch roller springs (not depicted in the drawings) with respect to the corresponding main conveying rollers 4 and 8 and sub conveying rollers 6 and 10, respectively. The print medium 3 is conveyed in the directions of arrows A and B by the pairs of conveying rollers.

In the print head 1 in the first print section, the nozzle array Y1-1 for the yellow ink is positioned on the most upstream side in the conveying direction (direction of arrow A). The nozzle array C3-1 for the cyan ink is positioned on the most downstream side in the conveying direction. As is the case with the above-described embodiments, the position of the nip portion of the pair of conveying rollers 4 and 5 is denoted by Pr1. The position of the nip portion of the pair of conveying rollers 6 and 7 is denoted by Pr2. In the print head 2 in the second print section, the nozzle array Y1-2 for the yellow ink is positioned on the most upstream side in the conveying direction (direction of arrow B). The nozzle array C3-2 for the cyan ink is positioned on the most downstream side in the conveying direction. As is the case with the above-described embodiments, the position of the nip portion of the pair of conveying rollers 8 and 9 is denoted by Pr3. The position of the nip portion of the pair of conveying rollers 10 and 11 is denoted by Pr4.

A U-turn section 112 is installed between the first print section and the second print section as a conveying section (third conveying section) configured to convey the print medium 3 from the first print section to the second print section. The print medium 3 is conveyed along an inner side surface of the U-turn section 112 to the second print section.

The U-turn section 112 is moved in the directions of arrows F1 and F2 by a motor gear 118 rotated by a motor 119 and a rack 117 integrated with the U-turn section 112 and meshed with the motor gear 118. The U-turn section 112 is moved in the directions of arrows F1 and F2 by the motor 119 to change the conveying path distance L (see FIG. 7) between the position Pr2 and the position Pr3. Movement of the U-turn section 112 in the direction of arrow F1 reduces the conveying path distance L. Movement of the U-turn section 112 in the direction of arrow F2 increases the conveying path distance L.

A sensor 116 configured to detect the leading end 3*a* and trailing end 3*b* of the print medium 3 is set on the upstream side of the first print section in the conveying direction. Based on a detection signal from the sensor 116 and the conveying speed for the print medium 3, the conveying-direction length PL of the print medium 3 is measured. When the length PL of the print medium 3 is detected, a moving operation of the U-turn section 112 in the direction of arrow F1 or F2 is immediately started in accordance with the length PL. The moving operation ends before the leading end 3*a* of the print medium 3 reaches a position opposite to the nozzle array Y1-1 in the print head 1.

Now, the movement position of the U-turn section 112 will be described.

First, a distance LL is set based on the conveying-direction length PL of the print medium 3 as indicated by:

$$LL=PL \qquad \text{Expression (20)}$$

Moreover, when a correction margin for a conveying distance for the print medium 3 is 10%, the distance LL is set taking the correction margin into account as indicated by Expression (21) illustrated below. The correction margin is calculated using a tolerance for the conveying-direction length of the print medium 3, an error in the movement position of the U-turn section 112, an error in the conveying path length of the U-turn section 112, and the like.

Moreover, when a margin-less printing is performed on the print medium 3, the distance LL is set taking into account the length of an ink ejection area (print area) spreading out from the print medium 3. For the margin-less printing, ink is ejected into the ejection area spreading out from the print medium 3 forward and backward in the conveying direction and spreading out from the print medium 3 in a lateral width direction. For example, when the ink ejection area spreads out from the print medium 3 by 10 mm forward and backward in the conveying direction, the total of the spreading length of the ejection area in the conveying direction is 20 mm. In this case, the distance LL is set taking into account the spreading length (10 mm) of the ink ejection area forward in the conveying direction as indicated by:

$$LL=(PL+10\text{ mm})\times 1.1 \qquad \text{Expression (21)}$$

Figure 8:
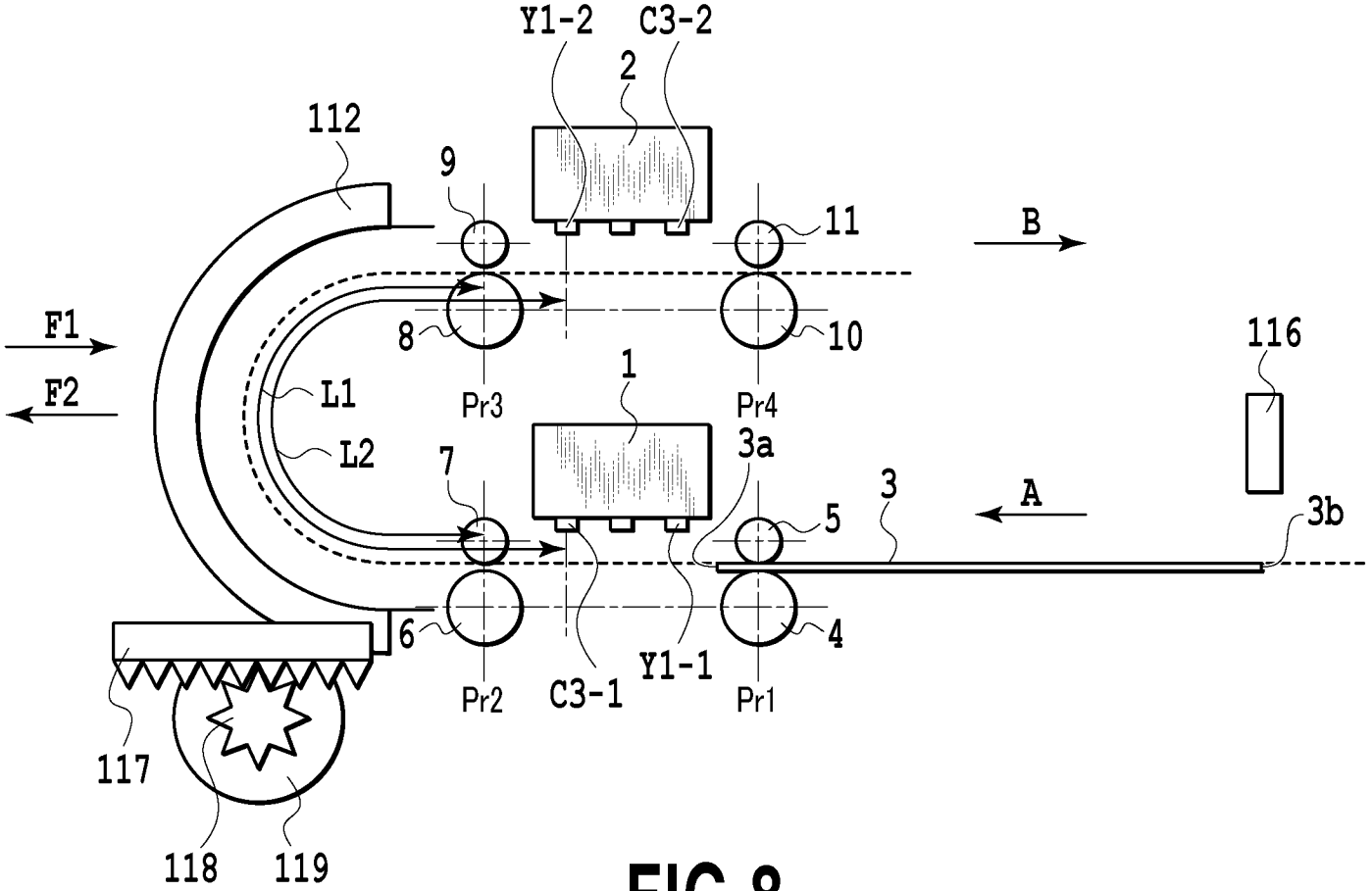
FIG. 8 is a diagram illustrating that a U-turn section in the printing apparatus in FIG. 7 moves to a different position.

As depicted in FIG. 8, the distance between the nozzle array C3-1, positioned on the most downstream side of the print head 1 in the conveying direction, and the position Pr3 of the nip portion of the pair of conveying rollers 8 and 9 is denoted by L1. Furthermore, the distance between the position Pr2 of the nip portion of the pair of conveying rollers 6 and 7 and the nozzle array Y1-2 positioned on the most upstream side of the print head 2 in the conveying direction is denoted by L2. In a case A where the distances L1 and L2 are in a relation represented by Expression (23) illustrated below, the above-described conveying path distance L in FIG. 7 is set so as to make the distance L1 equal to the distance LL as indicated by Expression (24) illustrated below.

Case A $$L1\geq L2 \qquad \text{Expression (23)}$$

$$L1=LL \qquad \text{Expression (24)}$$

On the other hand, in a case B where the distances L1 and L2 are as represented by Expression (25) illustrated below, the conveying path distance L in FIG. 7 is set so as to make the distance L2 equal to the distance LL as indicated by Expression (26) illustrated below.

Case B $$L1>L2 \qquad \text{Expression (25)}$$

$$L2=LL \qquad \text{Expression (26)}$$

Thus, when the distance L1 is equal to or shorter than the distance L2, the conveying path distance L is changed so as to make the distance L1 equal to the distance LL. When the distance L1 is longer than the distance L2, the conveying path distance L is changed so as to make the distance L2 equal to the distance LL. Therefore, the conveying path distance L is equal to or longer than the distances L1 and L2.

The relation between the distances L1 and L2 is fixed by the positions of the print head 1, the print head 2, the pair of conveying rollers 6 and 7, and the pair of conveying rollers 8 and 9. As described below, the U-turn section 112 is moved so as to set the conveying path distance L in the case A or the conveying path distance L in the case B.

When the conveying-direction maximum length of the print medium 3 is denoted by PLmax, the corresponding distance LLmax is set as follows in accordance with the relation between the distances L1 and L2. That is, in a case C where the distances L1 and L2 are in a relation represented by Expression (27) illustrated below, the conveying path distance L in FIG. 7 is set so as to make the distance L1 longer than the distance LLmax as indicated by Expression (28) illustrated below.

Case C $$L1\leq L2 \qquad \text{Expression (27)}$$

$$L1>LL\text{max} \qquad \text{Expression (28)}$$

On the other hand, in a case D where the distances L1 and L2 are in a relation represented by Expression (29) illustrated below, the conveying path distance L in FIG. 7 is set so as to make the distance L2 longer than the distance LLmax as indicated by Expression (30) illustrated below.

Case D $$L1>L2 \quad \text{Expression (29)}$$

$$L2>LL\text{max} \quad \text{Expression (30)}$$

Figure 10:
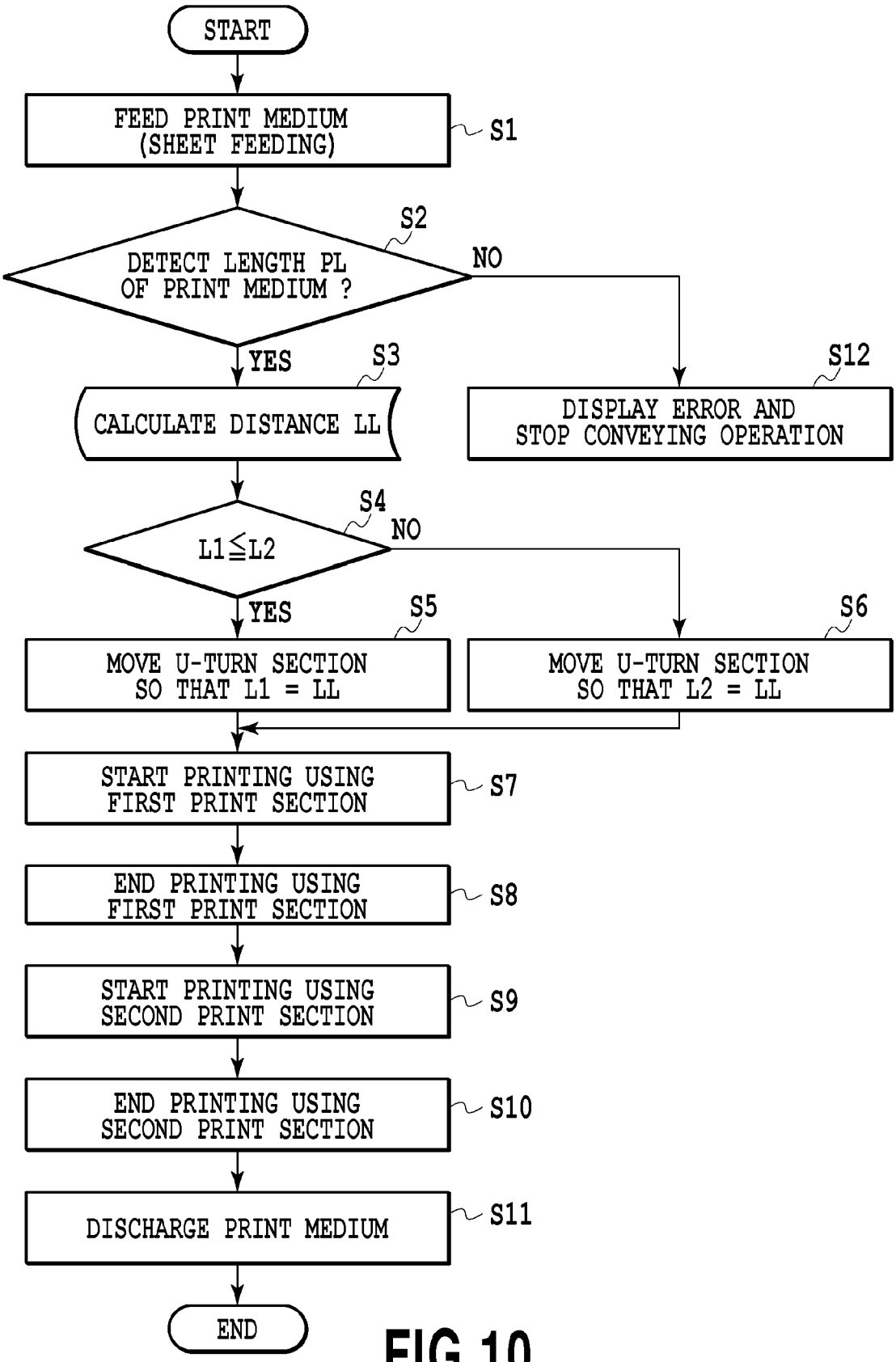
FIG. 10 is a flowchart illustrating a conveying operation and a printing operation in the printing apparatus in FIG. 7.

Now, operations of the printing apparatus configured as described above will be described based on a flowchart in FIG. 10 and schematic diagrams of an important part in FIGS. 11A, 11B, 11C, 12A, and 12B.

First, a printing operation is started to feed the print medium 3 to the print section (sheet feeding) (step S1). The leading end 3*a* and trailing end 3*b* of the print medium 3 are detected by the sensor 116 to allow the conveying-direction length PL of the print medium 3 to be detected (step S2). When the length PL of the print medium 3 is detected, the operation shifts to step S3. When the length PL of the print medium 3 fails to be detected, the operation shifts to step S12 to provide an error display, while stopping the conveying operation of the print medium 3.

In step S3, based on the detected length PL of the print medium 3, the distance LL is determined in accordance with Expression (21) illustrated above. In the case A where the distances L1 and L2 are in the relation indicated by Expression (23) illustrated above, step S4 shifts to step S5. In the case B where the distances L1 and L2 are in the relation indicated by Expression (25) illustrated above, step S4 shifts to step S6. In step S5, the U-turn section 112 is moved so as to make the distance L1 equal to LL. In step S6, the U-turn section 112 is moved so as to make the distance L2 equal to LL.

Figure 11A:
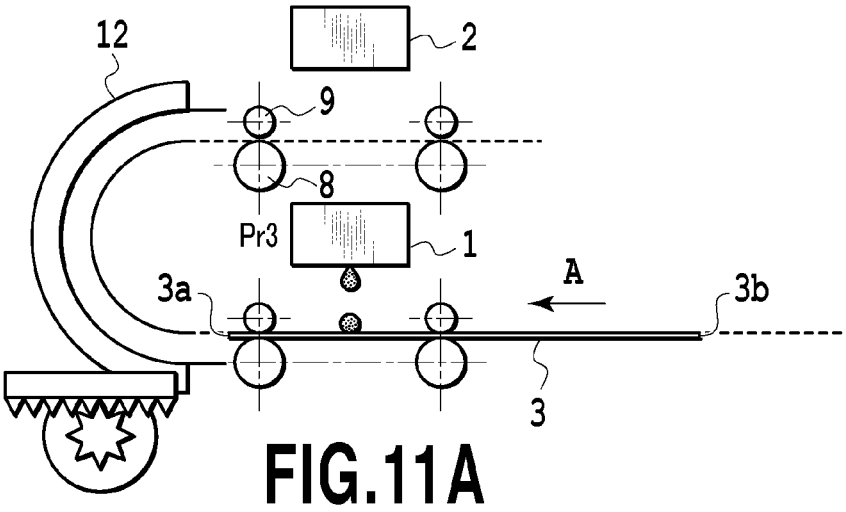
FIG. 11A, FIG. 11B, and FIG. 11C are each a diagram illustrating a sheet conveying operation in the printing apparatus in FIG. 7.
Figure 11B:
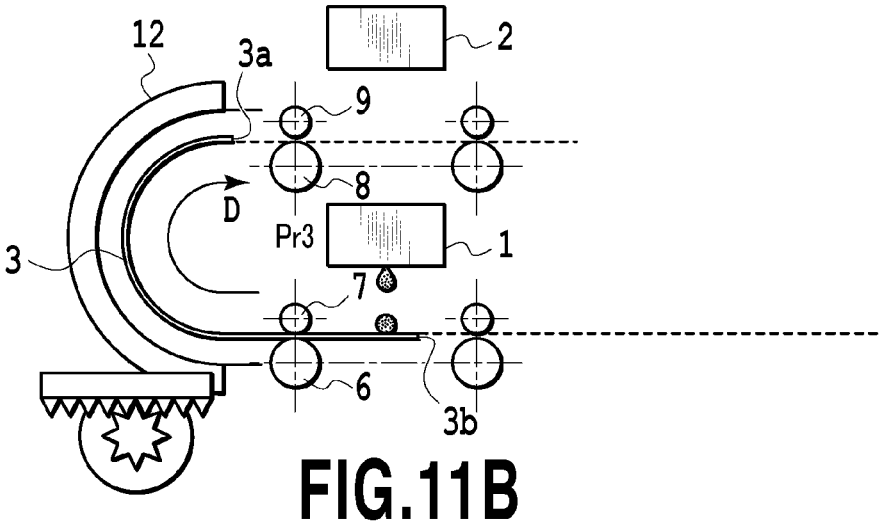

Subsequently, the leading end 3*a* of the print medium 3 reaches the position opposite to the nozzle array Y1-1 located on the most upstream side of the print head 1 in the conveying direction, and then, the first print section starts a printing operation (step S7). For the margin-less printing, the first print section starts a printing operation at a position short of the position opposite to the nozzle array Y1-1 (for example, a position 10 mm short of the position opposite to the nozzle array Y1-1). While the print medium 3 is being conveyed in the direction of arrow A as depicted in FIG. 11A, an image is printed on the print medium 3 by the print head 1 in the first print section. The print medium 3 is conveyed in the direction of arrow D along the U-turn section 112 as depicted in FIG. 11B. Printing of the print medium 3 is continued even when the leading end 3*a* of the print medium 3 does not reach the position Pr3 of the nip portion of the pair of conveying rollers 8 and 9. Then, when the trailing end 3*b* of the print medium 3 passes through a position opposite to the nozzle array C3-1 located on the most downstream side of the print head 1 in the conveying direction, the printing operation by the first print section is ended (step S8). For the margin-less printing, the printing operation is ended when the trailing end 3*b* of the print medium 3 has moves away, for example 10 mm, from the position opposite to the nozzle array C3-1.

Figure 11C:
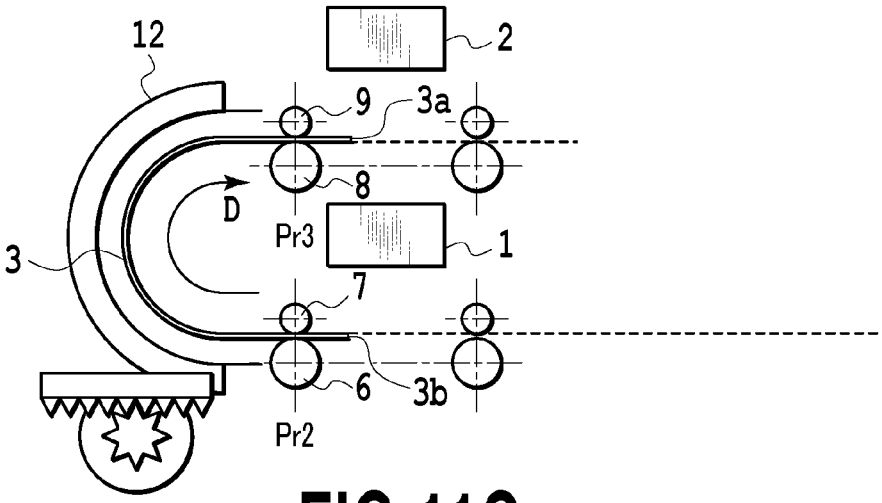

After the printing operation using the print head 1 thus ends, the print medium 3 is conveyed in the direction of arrow D as depicted in FIG. 11C. The leading end 3*a* of the print medium 3 reaches the position Pr3 of the nip portion of the pair of conveying rollers 8 and 9. Subsequently, the trailing end 3*b* of the print medium 3 leaves the position Pr2 of the nip portion of the pair of conveying rollers 6 and 7. In other words, after the printing operation using the print head 1 ends, the print medium 3 shifts from a state where the print medium 3 is conveyed only by the pair of conveying rollers 6 and 7 as depicted in FIG. 11B to a state where the print medium 3 is conveyed also by the pair of conveying rollers 8 and 9 as depicted in FIG. 11C. Subsequently, the trailing end 3*b* of the print medium 3 leaves the position Pr2 of the nip portion of the pair of conveying rollers 6 and 7. Thus, the print medium 3 is conveyed only by the pair of conveying rollers 8 and 9 as depicted in FIG. 12A.

Figure 12A:
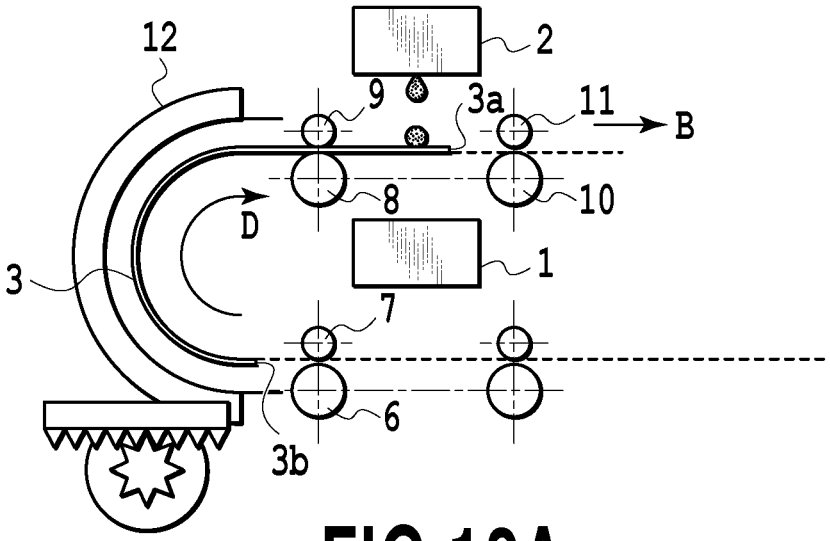
FIG. 12A and FIG. 12B are each a diagram illustrating the sheet conveying operation in the printing apparatus in FIG. 7.

When the leading end 3*a* of the print medium 3 reaches the position opposite to the nozzle array Y1-2 located on the most upstream side of the print head 2 in the conveying direction, the second print section starts a printing operation as depicted in FIG. 12A (step S9). For the margin-less printing, the second print section starts the printing operation at a position short of the position opposite to the nozzle array Y1-2 (for example, a position 10 mm short of the position opposite to the nozzle array Y1-2). The trailing end 3*b* of the print medium 3, which is separated from the position Pr2 of the nip portion of the pair of conveying rollers 6 and 7, moves along the U-turn section 112.

Figure 12B:
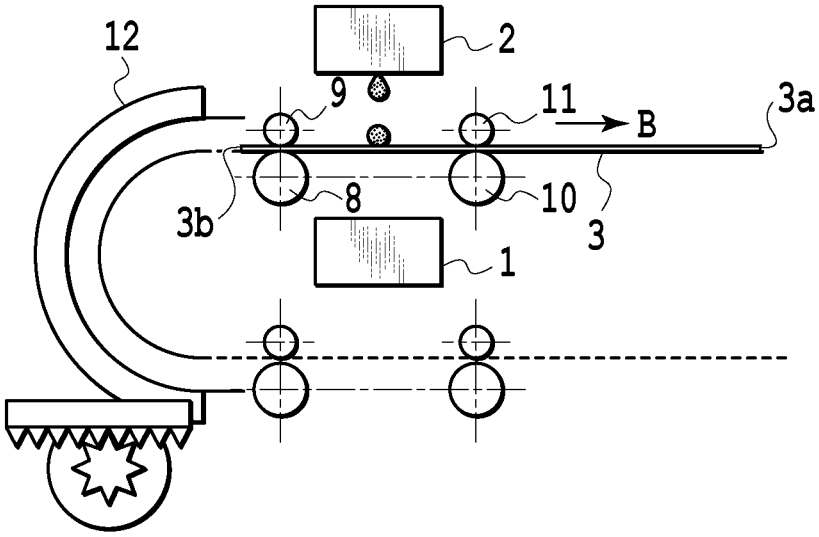

Subsequently, the print medium 3 is conveyed in the direction of arrow B by the pair of conveying rollers 8 and 9 and the pair of conveying rollers 10 and 11 as depicted in FIG. 12B. The print head 2 continues to perform the printing operation on the print medium 3 conveyed as described above. When the trailing end 3*b* of the print medium 3 passes through the nozzle array C3-2 located on the most downstream side of the print head 2 in the conveying direction, the printing operation by the second print section is ended (step S10). For the margin-less printing, the printing operation is ended when the trailing end 3*b* of the print medium 3 has moves away, for example 10 mm, from the position opposite to the nozzle array C3-2.

The print medium 3 with the image printed thereon is discharged from the print section (step S11). Thus, the conveying operation and printing operation on the first print medium 3 are ended. When an image is to be printed on the second or subsequent print medium, a similar conveying operation and a similar printing operation are repeated.

Thus, in the present embodiment, the leading end 3*a* of the print medium 3 is prevented from thrusting into the nip portion of the pair of conveying rollers 8 and 9 during printing using the print head 1. Furthermore, the print head 2 starts printing after the trailing end 3*b* of the print medium 3 separates from the nip portion of the pair of conveying rollers 6 and 7 in the first print section. Therefore, the printing using the first print section is not affected by the conveying rollers in the second print section. Additionally, the printing using the second print section is not affected by the conveying rollers in the first print section. As a result, the cause of a disturbance associated with the conveying operation for the print medium is eliminated to allow a high-quality image to be printed. Furthermore, the U-turn section 112 is moved in accordance with the conveying-direction length PL of the print medium 3 to allow the distance between the first print section and the second print section to be adjusted. Consequently, a high printing speed can be maintained without an overly long distance between the first print section and the second print section. The U-turn section 112 is not limited to the configuration in which U-turn section 112 is moved by the motor 119. For example, the movement position of the U-turn section 112 corresponding to the conveying-direction length PL of the print medium 3 may be preset so that the user can manually move the U-turn section 112 to the movement position.

Fourth Embodiment

Figure 13:
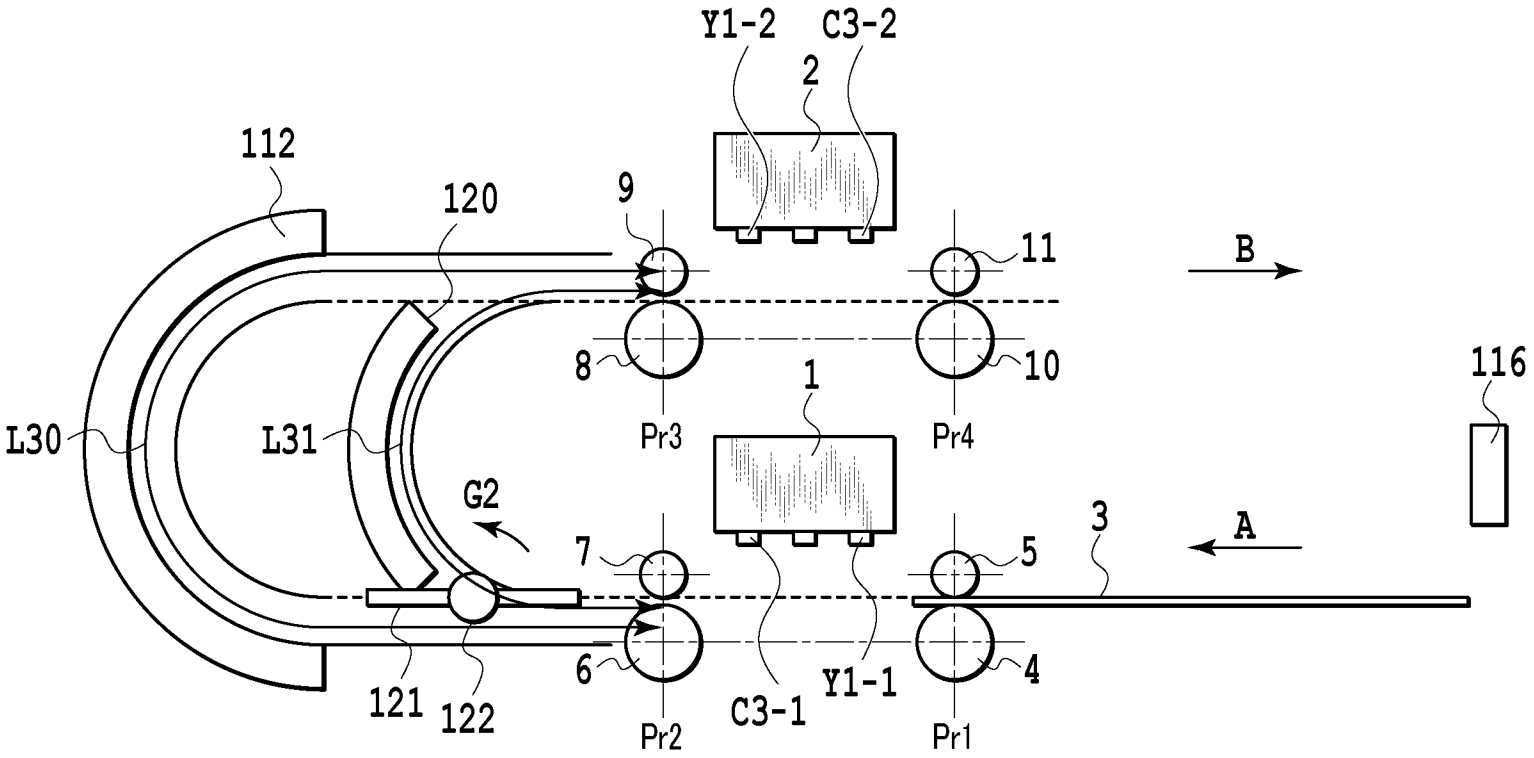
FIG. 13 is a configuration diagram of an important part of a printing apparatus according to a fourth embodiment of the present invention.
Figure 14:
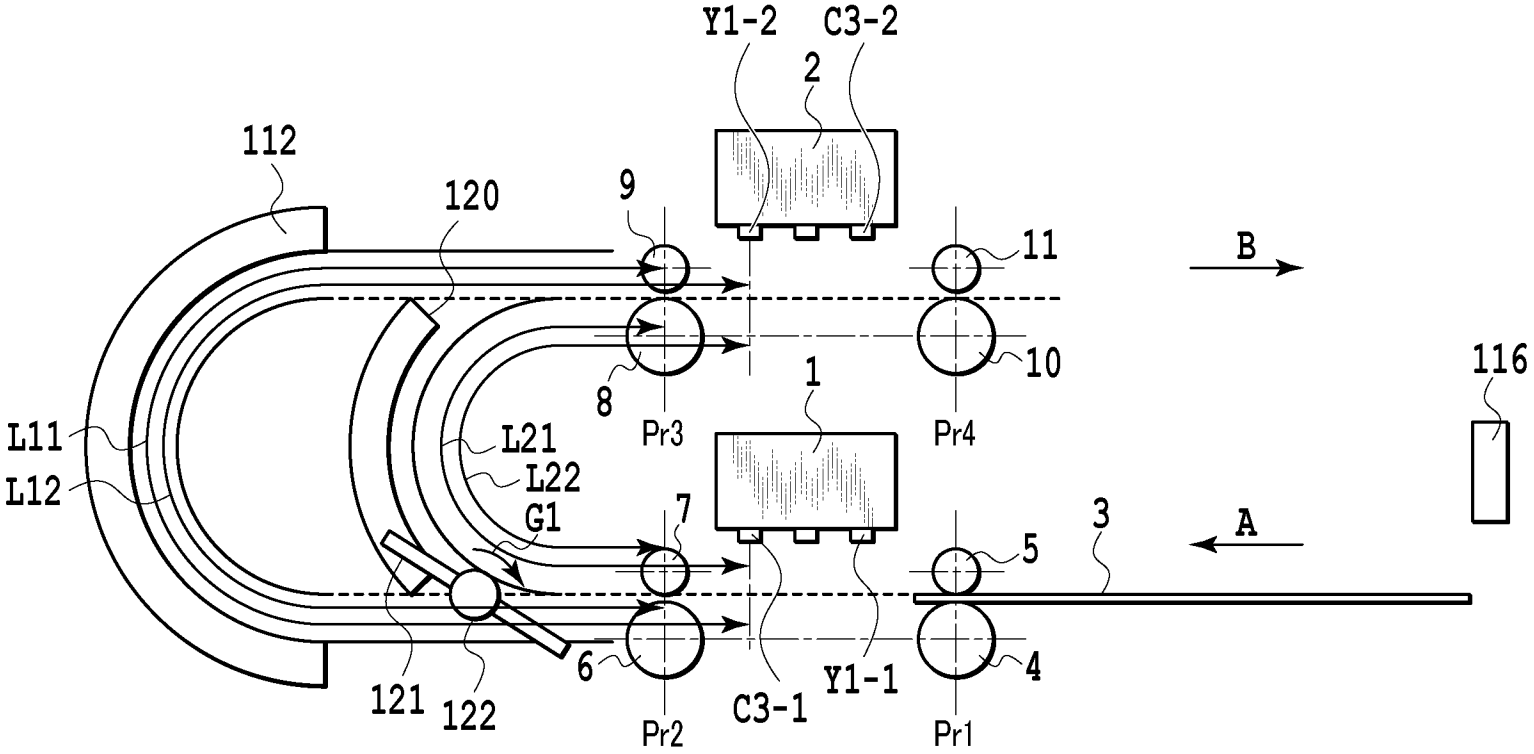
FIG. 14 is a diagram illustrating that a guide flapper in the printing apparatus in FIG. 13 rotates to a different position.

FIGS. 13 and 14 are diagrams illustrating an important part of a printing apparatus according to a fourth embodiment of the present invention.

Two U-turn sections 112 and 120 are installed between the first print section including the print head 1 and the second print section including the print head 2, as a conveying mechanism that conveys the print medium 3 conveyed from the first print section to the second print section. The print medium 3 conveyed to the first print section is conveyed through a first conveying path along an inner side surface of the U-turn section 112 or through a second conveying path along an inner side surface of U-turn section 120. One of the first and second conveying paths is selected by rotating a guide flapper 121. In other words, the first and second conveying paths can be used as a conveying section (third conveying section) that conveys the print medium 3 from the first print section to the second print section. As depicted in FIG. 13, the conveying path distance of the first conveying path between the position Pr2 and the position Pr3 is denoted by L30. The conveying path distance of the second conveying path between the position Pr2 and the position Pr3 is denoted by L31.

As is the case with the third embodiment, the distance LL is determined based on the conveying-direction length PL of the print medium 3. Furthermore, a distance from the nozzle array C3-1 located on the most downstream side of the print head 1 in the conveying direction, through the first conveying path to the position Pr3 of the nip portion of the pair of conveying rollers 8 and 9 is denoted by L11. A distance from the position Pr2 of the nip portion of the pair of conveying rollers 6 and 7 through the first conveying path to a nozzle array Y1-2 located on the most upstream side of the print head 2 is denoted by L12. Additionally, a distance from the nozzle array C3-1 located on the most downstream side of the print head 1 in the conveying direction, through the second conveying path to the position Pr3 of the nip portion of the pair of conveying rollers 8 and 9 is denoted by L21. A distance from the position Pr2 of the nip portion of the pair of conveying rollers 6 and 7 through the second conveying path to the nozzle array Y1-2 located on the most upstream side of the print head 2 is denoted by L22.

When a conveying path distance L30 is shorter than the distance L21 and the distance L22, the guide flapper 121 is rotated in the direction of arrow G1 as depicted in FIG. 14 to convey the print medium 3 along the inner side surface of U-turn section 120. On the other hand, when the conveying path distance L30 is longer than the distance L21 and the distance L22, the guide flapper 121 is rotated in the direction of arrow G2 as depicted in FIG. 13 to convey the print medium 3 along the inner side surface of U-turn section 112.

When the conveying-direction maximum length of the print medium 3 is denoted by PLmax, the corresponding distance LLmax is set as follows in accordance with the relation between the distances L11 and L12. That is, in a case E where the distances L11 and L12 are in a relation indicated by Expression (31) illustrated below, the conveying path distance L30 is set to make the distance L11 longer than the distance LLmax as indicated by Expression (32) illustrated below.

Case E $$L11 \leq L12 \quad \text{Expression (31)}$$

$$L11 > LL\max \quad \text{Expression (32)}$$

On the other hand, in a case F where the distances L11 and L12 are in a relation indicated by Expression (33) illustrated below, the conveying path distance L30 is set to make the distance L11 longer than the distance LLmax as indicated by Expression (34) illustrated below.

Case F $$L11 > L12 \quad \text{Expression (33)}$$

$$L11 > LL\max \quad \text{Expression (34)}$$

Fifth Embodiment

Figure 15:
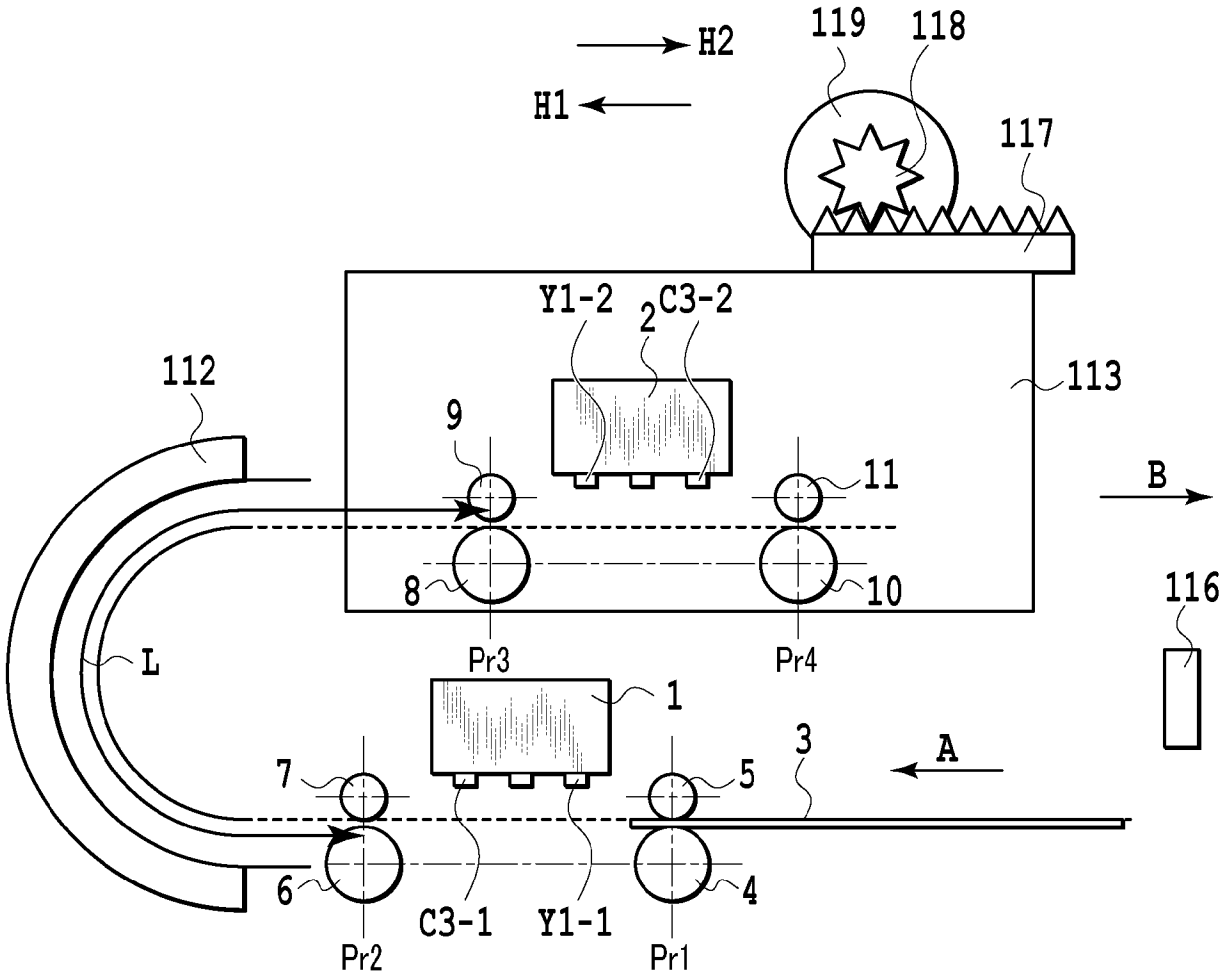
FIG. 15 is a configuration diagram of an important part of a printing apparatus according to a fifth embodiment of the present invention.

FIG. 15 is a diagram of an important part of a printing apparatus according to a fifth embodiment of the present invention.

In the present embodiment, the print head 2, the pair of conveying rollers 8 and 9, and the pair of conveying rollers 10 and 11 provide a print section unit 113. The print section unit 113 is moved in the directions of arrows H1 and H2 by a driving mechanism including a motor 119, a motor gear 118 rotated by the motor 119, and a rack 117 provided on the print section unit 113 to mesh with the motor gear 118. The motor 119 drives and moves the print section unit 113 in the directions of arrows H1 and H2. Such movement of the print section unit 113 increases and reduces a conveying path direction L from the position Pr2 of the nip portion of the pair of conveying rollers 6 and 7 to the position Pr3 of the nip portion of the pair of conveying rollers 8 and 9. The print section unit 113 moves in the direction of arrow H1 to reduce the conveying path distance L. The print section unit 113 moves in the direction of arrow H2 to increase the conveying path distance L.

As is the case with the above-described third embodiment, the distance LL is determined based on the conveying-direction length PL of the print medium 3. Then, the print section unit 113 is moved so as to establish a state equivalent to the case A or case B according to the third embodiment. Furthermore, when the conveying path distance calculated from the conveying-direction maximum length PLmax of the print medium 3 is denoted by LLmax, the movement position of the print section unit 113 is set to establish a state equivalent to the case C or case D according to the third embodiment. When the conveying-direction length of the print medium 3 is shorter than the maximum length PLmax, the print section unit 113 is moved in the direction of arrow H1.

Sixth Embodiment

Figure 16:
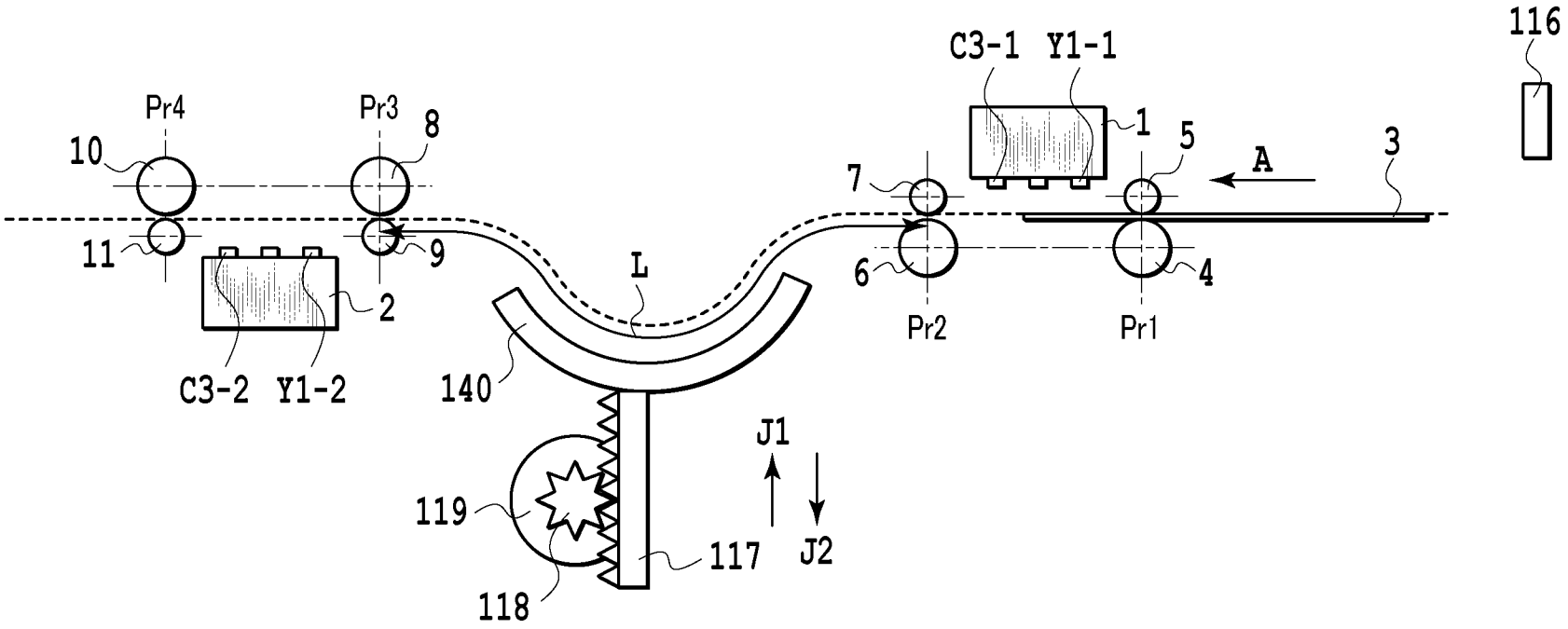
FIG. 16 is a configuration diagram of an important part of a printing apparatus according to a sixth embodiment of the present invention.

FIG. 16 is a diagram illustrating an important part of a printing apparatus according to a sixth embodiment of the present invention. In the present embodiment, the first print section and the second print section are disposed on a substantially straight line. The conveying section configured to convey the print medium 3 from the first print section to the second print section is provided between these two print sections. The conveying section has a curved portion 140.

The curved portion 140 is moved in the directions of arrows J1 and J2 by a driving mechanism including a motor 119, a motor gear 118 driven by the motor 119 to rotate, and a rack 117 integrated with the curved portion 140 to mesh with the motor gear 118. The motor 119 drives and moves the curved portion 140 in the directions of arrows J1 and J2. This increases and reduces a conveying path direction L from the position Pr2 of the nip portion of the pair of conveying rollers 6 and 7 to the position Pr3 of the nip portion of the pair of conveying rollers 8 and 9. The curved portion 140 moves in the direction of arrow J1 to reduce the conveying path distance L. The curved portion 140 moves in the direction of arrow J2 to increase the conveying path distance L.

As is the case with the above-described third embodiment, the distance LL is determined based on the conveying-direction length PL of the print medium 3. Then, the curved portion 140 is moved so as to establish a state equivalent to the case A or case B according to the third embodiment. Furthermore, when the distance calculated from the conveying-direction maximum length PLmax of the print medium 3 is denoted by LLmax, the movement position of the curved portion 140 is set to establish a state equivalent to the case C or case D according to the third embodiment. When the conveying-direction length of the print medium 3 is shorter than the maximum length PLmax, the curved portion 140 is moved in the direction of arrow J1.

Seventh Embodiment

Figure 17:
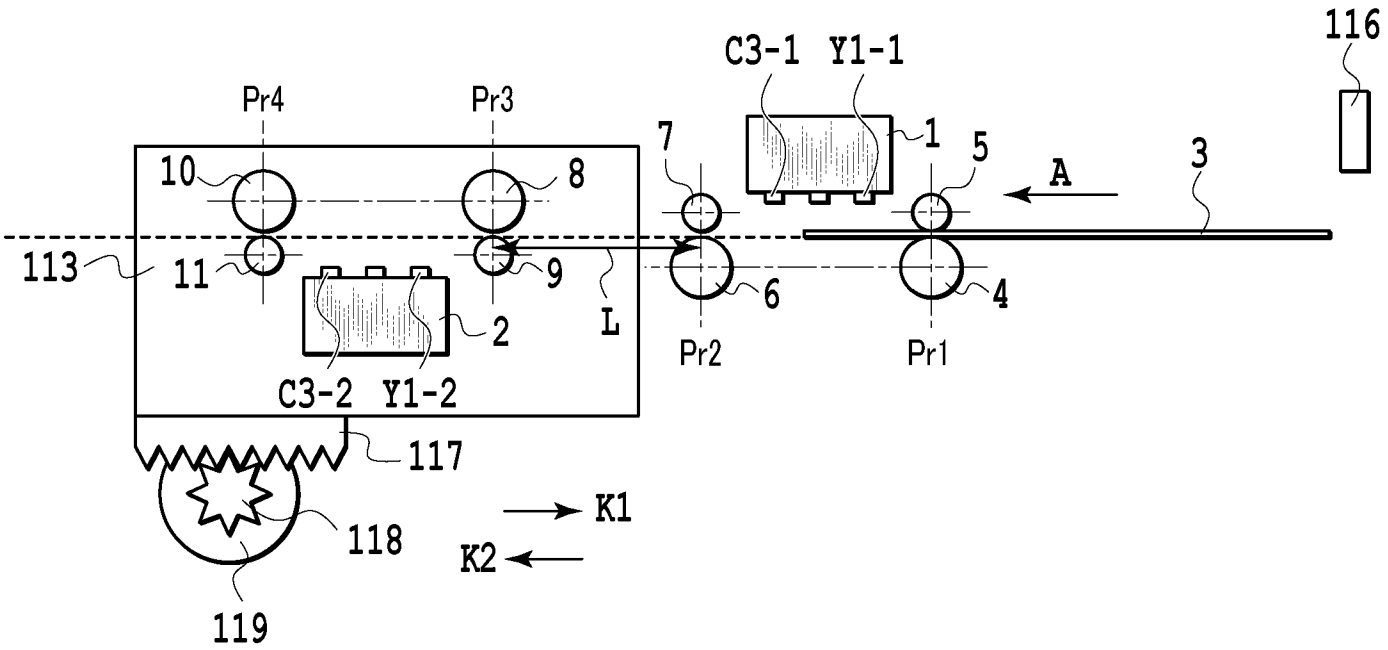
FIG. 17 is a configuration diagram of an important part of a printing apparatus according to a seventh embodiment of the present invention.

FIG. 17 is a diagram illustrating an important part of a printing apparatus according to a seventh embodiment of the present invention.

The first print section with the print head 1 and the second print section with the print head 2 are disposed on a substantially straight line. The print head 2, the pair of conveying rollers 8 and 9, and the pair of conveying rollers 10 and 11 provide a print section unit 113. The print section unit 113 is moved in the directions of arrows K1 and K2 by a driving mechanism including a motor 119, a motor gear 118 driven and rotated by the motor 119, and a rack 117 integrated with the print section unit 113 to mesh with the motor gear 118. The motor 119 drives and moves the print section unit 113 to increase or reduce the conveying path direction L from the position Pr2 of the nip portion of the pair of conveying rollers 6 and 7 to the position Pr3 of the nip portion of the pair of conveying rollers 8 and 9. The print section unit 113 moves in the direction of arrow K1 to reduce the conveying path distance L. The print section unit 113 moves in the direction of arrow K2 to increase the conveying path distance L.

As is the case with the above-described third embodiment, the distance LL is determined based on the conveying-direction length PL of the print medium 3. Then, the print section unit 113 is moved so as to establish a state equivalent to the case A or case B according to the third embodiment. Furthermore, when the conveying path distance calculated from the conveying-direction maximum length PLmax of the print medium 3 is denoted by LLmax, the movement position of the print section unit 113 is set to establish a state equivalent to the case C or case D according to the third embodiment. When the conveying-direction length of the print medium 3 is shorter than the maximum length PLmax, the print section unit 113 is moved in the direction of arrow K1.

Eighth Embodiment

Figure 18:
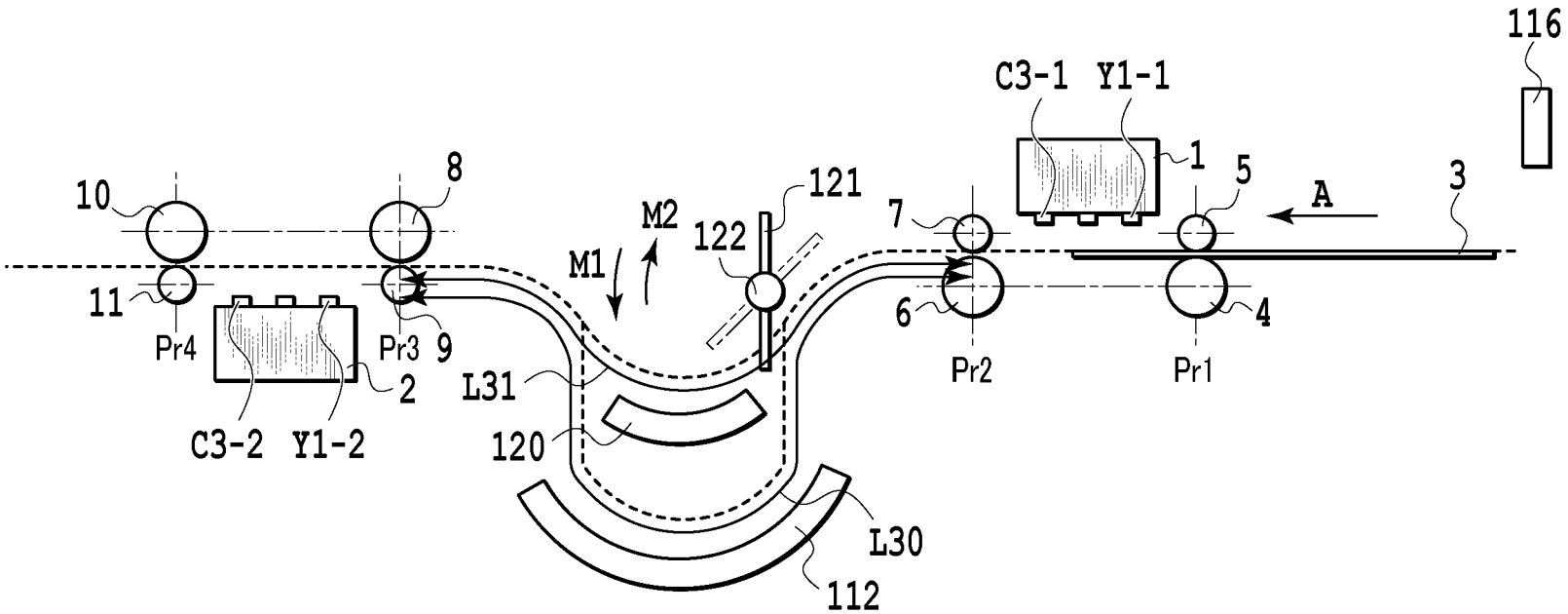
FIG. 18 is a configuration diagram of an important part of a printing apparatus according to an eighth embodiment of the present invention.

FIG. 18 is a diagram illustrating an important part of a printing apparatus according to an eighth embodiment of the present invention.

The first print section with the print head 1 and the second print section with the print head 2 are disposed on a substantially straight line. Between the print sections, a conveying section is provided which is configured to convey the print medium 3 from the first print section to the second print section. The conveying section includes two U-turn sections 112 and 120. The print medium 3 is conveyed to the second print section through a first conveying path along an inner side surface of the U-turn section 112 or through a second conveying path along an inner side surface of the U-turn section 120. One of the first and second conveying paths is selected by rotating a guide flapper 123 in the direction of arrow M1 or M2.

As is the case with the above-described fourth embodiment, the distance L30 is determined based on the conveying-direction length PL of the print medium 3. As is the case with the fourth embodiment, when the conveying path distance L30 is shorter than the distance L21 and the distance L22, the guide flapper 121 rotates in the direction of arrow M2 as depicted by a dotted line in FIG. 18 to convey the print medium 3 along the inner side surface of the U-turn section 120. On the other hand, when the conveying path distance L30 is longer than the distance L21 and the distance L22, the guide flapper 121 rotates in the direction of arrow M1 as depicted by a solid line in FIG. 18 to convey the print medium 3 along the inner side surface of the U-turn section 112. Furthermore, when the conveying pathe distance calculated from the conveying-direction maximum length PLmax of the print medium 3 is denoted by LLmax, one of the first and second conveying paths is selected to establish a state equivalent to the case E or case F according to the fourth embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-077466, filed Apr. 4, 2014 which is hereby incorporated by reference wherein in its entirety.

What is claimed is:

1. A printing apparatus comprising:

a first conveying unit configured to convey a sheet through a first conveying path;

a first print unit configured to print an image on the sheet in the first conveying path;

a second conveying unit configured to convey the sheet through the second conveying path;

a second print unit configured to print an image on the sheet in the second conveying path; and a guide unit configured to guide the sheet conveyed through the first conveying path to the second conveying path through a third conveying path with a changeable length.

2. The printing apparatus according to claim 1, wherein the guide unit changes the length of the third conveying path so as to absorb slack of the sheet between the first conveying path and the second conveying path.

3. The printing apparatus according to claim 1, wherein the guide unit includes a guide element which comprises a guide surface forming the third conveying path and which is movable in a direction in which the length of the third conveying path is changed.

4. The printing apparatus according to claim 3, wherein the guide element is biased in a direction in which the third conveying path is shortened and moves in a direction in which the third conveying path is elongated in accordance with an amount of slack in the sheet between the first conveying unit and the second conveying unit.

5. The printing apparatus according to claim 1, wherein the guide unit comprises a plurality of conveying paths which are usable as the third conveying path and which have different lengths, and one of the plurality of conveying paths is selected and used as the third conveying path.

6. The printing apparatus according to claim 1, wherein the length of the third conveying path is changed by moving at least one of the first and second conveying units.

7. The printing apparatus according to claim 1, wherein the length of the third conveying path is changed in accordance with a conveying-direction length of the sheet.

8. The printing apparatus according to claim 1, wherein, in order to convey the sheet in a first conveying direction, the first conveying unit includes a first pair of upstream side conveying rollers positioned on an upstream side of the first print unit in the first conveying direction and a first pair of downstream side conveying rollers positioned on a downstream side of the first print unit in the first conveying direction, the first pair of downstream side conveying rollers having a higher sheet conveying speed than the first pair of upstream side conveying rollers, and in order to convey the sheet in a second conveying direction, the second conveying unit includes a second pair of upstream side conveying rollers positioned on an upstream side of the first print unit in the second conveying direction and a second pair of downstream side conveying rollers positioned on a downstream side of the second print unit in the second conveying direction, the second pair of downstream side conveying rollers having a higher sheet conveying speed than the second pair of upstream side conveying rollers.

9. The printing apparatus according to claim 8, wherein, when a distance between a print position where the first print unit prints an image on the sheet and a position of the second pair of upstream side conveying rollers is denoted by L1 and a distance between a position of the first pair of downstream side conveying rollers and a print position where the second print unit prints an image on the sheet is denoted by L2, the length of the third conveying path is changed so as to make a conveying-direction length PL of the sheet equal to or longer than the distances L1 and L2.

10. The printing apparatus according to claim 9, wherein the length of the third conveying path is changed so as to make the distance L1 equal to the length PL when the distance L1 is equal to or shorter than the distance L2 and so as to make the distance L2 equal to the length PL when the distance L1 is longer than the distance L2.

11. The printing apparatus according to claim 10, wherein the conveying-direction length PL of the sheet is equal to a distance LL resulting from addition, to the length PL, of at least one of a correction margin and a spreading amount by which a print area spreads out from the sheet during margin less printing.

12. The printing apparatus according to claim 9, wherein the length of the third conveying path is changed so as to make the distance L1 longer than a conveying-direction maximum length PLmax of the sheet when the distance L1 is equal to or shorter than the distance L2 and so as to make the distance L2 longer than the conveying-direction maximum length PLmax of the sheet when the distance L1 is longer than the distance L2.

13. The printing apparatus according to claim 12, wherein the conveying-direction maximum length PLmax of the sheet is equal to a distance LLmax resulting from addition, to the length PLmax, of at least one of a correction margin and a spreading amount by which a print area spreads out from the sheet during margin less printing.

14. The printing apparatus according to claim 1, wherein the third conveying path is curved.

15. The printing apparatus according to claim 1, wherein the first print unit prints an image on one surface of the sheet, and the second print unit prints an image on another surface of the sheet.

16. The printing apparatus according to claim 15, wherein the third conveying path includes a curved portion formed between an outer peripheral guide surface and an inner peripheral guide surface, one surface of the sheet is opposite to the inner peripheral guide surface, and the another surface of the sheet is opposite to the outer peripheral guide surface.

17. A printing method comprising:

a first conveying step of conveying a sheet through a first conveying path;

a first print step of printing an image on the sheet in the first conveying path;

a second conveying step of conveying the sheet through the second conveying path;

a second print step of printing an image on the sheet in the second conveying path;

a step of guiding the sheet conveyed through the first conveying path to the second conveying path through a third conveying path; and a step of changing a length of the third conveying path so as to absorb slack in the sheet between the first conveying path and the second conveying path.

* * * * *